US008443958B2

(12) United States Patent
Blake et al.

(10) Patent No.: US 8,443,958 B2
(45) Date of Patent: May 21, 2013

(54) APPARATUS, SYSTEM AND METHOD FOR COIN EXCHANGE

(75) Inventors: John R. Blake, St. Charles, IL (US); Curtis W. Hallowell, Palatine, IL (US); William J. Jones, Barrington, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 237 days.

(21) Appl. No.: 12/346,767

(22) Filed: Dec. 30, 2008

(65) Prior Publication Data

US 2009/0236201 A1 Sep. 24, 2009

Related U.S. Application Data

(60) Continuation-in-part of application No. 11/726,828, filed on Mar. 23, 2007, and a continuation-in-part of application No. 11/803,281, filed on May 14, 2007, now Pat. No. 7,949,582, which is a continuation of application No. 10/084,856, filed on Feb. 27, 2002, which is a division of application No. 08/814,978, filed on Mar. 11, 1997, now Pat. No. 6,363,164, which is a continuation-in-part of application No. 08/664,262, filed on May 13, 1996, now Pat. No. 5,982,918, said application No. 12/346,767 is a continuation-in-part of application No. 11/945,671, filed on Nov. 27, 2007, now abandoned, which is a division of application No. 10/393,867, filed on Mar. 20, 2003, now Pat. No. 7,349,566, which is a division of application No. 09/059,813, filed on Apr. 14, 1998, now Pat. No. 6,661,910.

(60) Provisional application No. 61/038,730, filed on Mar. 21, 2008, provisional application No. 60/031,604, filed on Nov. 27, 1996, provisional application No. 60/043,516, filed on Apr. 14, 1997, provisional application No. 60/053,606, filed on Jul. 22, 1997.

(51) Int. Cl.
*G07F 9/08* (2006.01)

(52) U.S. Cl.
USPC ..... 194/215

(58) Field of Classification Search
USPC ..... 194/215; 235/379; 209/534
See application file for complete search history.

(56) References Cited

U.S. PATENT DOCUMENTS 2,570,920 A 10/1951 Clough et al.
2,669,998 A 2/1954 Buchholz (Continued)

FOREIGN PATENT DOCUMENTS

CA 2 235 925 11/1995
CA 2 189330 12/2000

(Continued)

OTHER PUBLICATIONS

International Search Report corresponding to co-pending International Patent Application Serial No. GB0904896.8, Great Britain, dated Jun. 29, 2009; 2 pages.

(Continued)

*Primary Examiner* — Mark Beauchaine
(74) *Attorney, Agent, or Firm* — Nixon Peabody LLP

(57) ABSTRACT

A method for exchanging coins, the method including the acts of receiving in a self-service coin exchange machine a plurality of coins, processing the plurality of coins to determine a total value of the plurality of coins, and dispensing currency to the patron from a currency dispenser, the currency having a value related to the total value.

6 Claims, 6 Drawing Sheets

U.S. PATENT DOCUMENTS

| | | | | | |
|---|---|---|---|---|---|
| 2,750,949 | A | | 6/1956 | Kulo et al. | |
| 2,835,260 | A | | 5/1958 | Buchholz | |
| 2,865,561 | A | | 12/1958 | Rosapepe | |
| 3,132,654 | A | | 5/1964 | Adams | |
| 3,227,363 | A | * | 1/1966 | Hecker et al. | 235/7 R |
| 3,778,595 | A | | 12/1973 | Hatanaka et al. | |
| 3,916,922 | A | | 11/1975 | Prumm | |
| 3,998,237 | A | | 12/1976 | Kressin | |
| 3,998,379 | A | | 12/1976 | Myers et al. | 229/33 |
| 4,050,218 | A | | 9/1977 | Call | 53/167 |
| 4,059,122 | A | | 11/1977 | Kinoshita | |
| 4,075,460 | A | | 2/1978 | Gorgens | |
| 4,150,740 | A | * | 4/1979 | Douno | 194/206 |
| 4,166,945 | A | | 9/1979 | Inoyama et al. | |
| 4,172,462 | A | | 10/1979 | Uchida et al. | |
| 4,179,685 | A | | 12/1979 | O'Maley | |
| 4,179,723 | A | | 12/1979 | Spencer | |
| 4,197,986 | A | | 4/1980 | Nagata | |
| 4,208,549 | A | | 6/1980 | Polillo et al. | |
| 4,232,295 | A | | 11/1980 | McConnell | |
| 4,234,003 | A | | 11/1980 | Ristvedt et al. | 133/3 |
| 4,249,552 | A | | 2/1981 | Margolin et al. | |
| 4,251,867 | A | | 2/1981 | Uchida et al. | |
| 4,286,703 | A | | 9/1981 | Schuller et al. | |
| RE30,773 | E | | 10/1981 | Glaser et al. | |
| 4,310,885 | A | | 1/1982 | Azcua et al. | |
| 4,317,957 | A | | 3/1982 | Sendrow | |
| 4,341,951 | A | | 7/1982 | Benton | |
| 4,355,369 | A | | 10/1982 | Garvin | |
| 4,360,034 | A | | 11/1982 | Davila et al. | |
| 4,369,442 | A | | 1/1983 | Werth et al. | |
| 4,380,316 | A | | 4/1983 | Glinka et al. | |
| 4,383,540 | A | | 5/1983 | DeMeyer et al. | |
| 4,385,285 | A | | 5/1983 | Horst et al. | |
| 4,412,292 | A | | 10/1983 | Sedam et al. | |
| 4,416,299 | A | | 11/1983 | Bergman | |
| 4,417,136 | A | | 11/1983 | Rushby et al. | |
| 4,423,316 | A | | 12/1983 | Sano et al. | |
| 4,434,359 | A | | 2/1984 | Watanabe | |
| 4,454,414 | A | | 6/1984 | Benton | |
| 4,531,531 | A | | 7/1985 | Johnson et al. | 133/3 |
| 4,543,969 | A | | 10/1985 | Rasmussen | 133/3 |
| 4,549,561 | A | | 10/1985 | Johnson et al. | 133/3 |
| 4,556,140 | A | | 12/1985 | Okada | |
| 4,558,711 | A | | 12/1985 | Yoshiaki et al. | |
| 4,564,036 | A | | 1/1986 | Ristvedt | 133/3 |
| 4,570,655 | A | | 2/1986 | Raterman | 133/3 |
| 4,594,664 | A | | 6/1986 | Hashimoto | |
| 4,602,332 | A | | 7/1986 | Hirose et al. | |
| 4,620,559 | A | | 11/1986 | Childers et al. | |
| 4,641,239 | A | * | 2/1987 | Takesako | 705/41 |
| 4,674,260 | A | | 6/1987 | Rasmussen et al. | 53/212 |
| 4,681,128 | A | | 7/1987 | Ristvedt et al. | 453/6 |
| 4,718,218 | A | | 1/1988 | Ristvedt | 53/532 |
| 4,731,043 | A | | 3/1988 | Ristvedt et al. | 453/6 |
| 4,733,765 | A | | 3/1988 | Watanabe | |
| 4,765,464 | A | | 8/1988 | Ristvedt | 206/0.82 |
| 4,766,548 | A | | 8/1988 | Cedrone et al. | |
| 4,775,353 | A | | 10/1988 | Childers et al. | |
| 4,775,354 | A | | 10/1988 | Rasmussen et al. | 453/10 |
| 4,778,983 | A | | 10/1988 | Ushikubo | |
| 4,803,347 | A | | 2/1989 | Sugahara et al. | |
| 4,804,830 | A | | 2/1989 | Miyagisima et al. | |
| 4,812,629 | A | | 3/1989 | O'Neil et al. | |
| 4,839,505 | A | | 6/1989 | Bradt et al. | |
| 4,844,369 | A | | 7/1989 | Kanayachi | |
| 4,863,414 | A | | 9/1989 | Ristvedt et al. | 453/6 |
| 4,883,158 | A | | 11/1989 | Kobayashi et al. | |
| 4,884,212 | A | | 11/1989 | Stutsman | |
| 4,900,909 | A | | 2/1990 | Nagashima et al. | |
| 4,908,516 | A | | 3/1990 | West | |
| 4,921,463 | A | | 5/1990 | Primdahl et al. | 453/3 |
| 4,953,086 | A | | 8/1990 | Fukatsu | |
| 4,954,697 | A | | 9/1990 | Kokubun et al. | |
| 4,964,495 | A | | 10/1990 | Rasmussen | 194/344 |
| 4,966,570 | A | | 10/1990 | Ristvedt et al. | 453/6 |
| 4,970,655 | A | | 11/1990 | Winn et al. | |
| 4,988,849 | A | | 1/1991 | Sasaki et al. | |
| 4,992,647 | A | | 2/1991 | Konishi et al. | |
| 4,995,848 | A | | 2/1991 | Goh | |
| 5,009,627 | A | | 4/1991 | Rasmussen | 453/10 |
| 5,010,238 | A | | 4/1991 | Kadono et al. | |
| 5,010,485 | A | | 4/1991 | Bigari | |
| 5,011,455 | A | | 4/1991 | Rasmussen | 453/10 |
| 5,022,889 | A | | 6/1991 | Ristvedt et al. | 453/6 |
| 5,025,139 | A | | 6/1991 | Halliburton, Jr. | |
| 5,026,320 | A | | 6/1991 | Rasmussen | 453/6 |
| 5,031,098 | A | | 7/1991 | Miller et al. | |
| 5,039,848 | A | | 8/1991 | Stoken | |
| 5,055,086 | A | | 10/1991 | Raterman et al. | 453/10 |
| 5,055,657 | A | | 10/1991 | Miller et al. | |
| 5,064,999 | A | | 11/1991 | Okamoto et al. | |
| 5,080,633 | A | | 1/1992 | Ristvedt et al. | 435/6 |
| 5,091,713 | A | | 2/1992 | Horne et al. | |
| 5,104,353 | A | | 4/1992 | Ristvedt et al. | 453/6 |
| 5,105,601 | A | | 4/1992 | Horiguchi et al. | |
| 5,106,338 | A | | 4/1992 | Rasmussen et al. | 453/10 |
| 5,111,927 | A | | 5/1992 | Schulze | |
| 5,114,381 | A | | 5/1992 | Ueda et al. | |
| 5,120,945 | A | | 6/1992 | Nishibe et al. | |
| 5,123,873 | A | | 6/1992 | Rasmussen | 453/10 |
| 5,129,205 | A | | 7/1992 | Rasmussen | 53/52 |
| 5,135,435 | A | | 8/1992 | Rasmussen | 453/56 |
| 5,140,517 | A | | 8/1992 | Nagata et al. | |
| 5,141,443 | A | | 8/1992 | Rasmussen et al. | 453/10 |
| 5,141,472 | A | | 8/1992 | Todd et al. | 453/10 |
| 5,145,455 | A | | 9/1992 | Todd | 453/6 |
| 5,146,067 | A | | 9/1992 | Sloan et al. | |
| 5,154,272 | A | | 10/1992 | Nishiumi et al. | |
| 5,163,672 | A | | 11/1992 | Mennie | 271/187 |
| 5,163,866 | A | | 11/1992 | Rasmussen | 453/10 |
| 5,163,867 | A | | 11/1992 | Rasmussen | 453/10 |
| 5,163,868 | A | | 11/1992 | Adams et al. | |
| 5,167,313 | A | | 12/1992 | Dobbins et al. | |
| 5,175,416 | A | | 12/1992 | Mansvelt et al. | |
| 5,176,565 | A | | 1/1993 | Ristvedt et al. | 453/6 |
| 5,179,517 | A | | 1/1993 | Sarbin et al. | |
| 5,183,142 | A | * | 2/1993 | Latchinian et al. | 194/206 |
| 5,184,709 | A | | 2/1993 | Nishiumi et al. | |
| 5,194,037 | A | | 3/1993 | Jones et al. | 453/10 |
| 5,197,919 | A | | 3/1993 | Geib et al. | 453/10 |
| 5,205,780 | A | | 4/1993 | Rasmussen | 453/10 |
| 5,207,784 | A | | 5/1993 | Schwartzendruber | |
| 5,207,788 | A | | 5/1993 | Geib | 271/122 |
| 5,209,696 | A | | 5/1993 | Rasmussen et al. | 453/10 |
| 5,243,174 | A | | 9/1993 | Veeneman et al. | |
| 5,251,738 | A | | 10/1993 | Dabrowski | |
| 5,252,811 | A | | 10/1993 | Henochowicz et al. | |
| 5,253,167 | A | | 10/1993 | Yoshida et al. | |
| 5,265,874 | A | | 11/1993 | Dickinson et al. | |
| 5,268,561 | A | | 12/1993 | Kimura et al. | |
| 5,277,651 | A | | 1/1994 | Rasmussen et al. | 453/10 |
| 5,282,127 | A | | 1/1994 | Mii | |
| 5,286,226 | A | | 2/1994 | Rasmussen | 453/10 |
| 5,286,954 | A | | 2/1994 | Sato et al. | |
| 5,291,003 | A | | 3/1994 | Avnet et al. | |
| 5,293,981 | A | | 3/1994 | Abe et al. | |
| 5,295,196 | A | | 3/1994 | Raterman et al. | 382/135 |
| 5,297,030 | A | | 3/1994 | Vassigh et al. | |
| 5,297,598 | A | | 3/1994 | Rasmussen | 141/314 |
| 5,297,986 | A | | 3/1994 | Ristvedt et al. | 453/6 |
| 5,299,977 | A | | 4/1994 | Mazur et al. | 453/10 |
| 5,326,104 | A | | 7/1994 | Pease et al. | |
| 5,370,575 | A | | 12/1994 | Geib et al. | 453/3 |
| 5,372,542 | A | | 12/1994 | Geib et al. | 453/10 |
| 5,374,814 | A | | 12/1994 | Kako et al. | |
| 5,379,344 | A | | 1/1995 | Larson et al. | |
| 5,382,191 | A | | 1/1995 | Rasmussen | 453/11 |
| 5,390,776 | A | | 2/1995 | Thompson | |
| 5,401,211 | A | | 3/1995 | Geib et al. | 453/10 |
| 5,410,590 | A | | 4/1995 | Blood et al. | |
| RE34,934 | E | | 5/1995 | Raterman et al. | 453/10 |
| 5,425,669 | A | | 6/1995 | Geib et al. | 453/10 |
| 5,429,550 | A | | 7/1995 | Mazur et al. | 453/10 |
| 5,450,938 | A | | 9/1995 | Rademacher | |
| 5,453,047 | A | | 9/1995 | Mazur et al. | 453/10 |
| 5,467,405 | A | | 11/1995 | Raterman et al. | 382/135 |

5,467,406 A 11/1995 Graves et al. ..... 382/135
5,468,182 A 11/1995 Geib ..... 453/10
5,470,079 A 11/1995 LeStrange et al.
5,474,495 A 12/1995 Geib et al. ..... 453/3
5,474,497 A 12/1995 Jones et al. ..... 453/17
5,480,348 A 1/1996 Mazur et al. ..... 453/10
5,489,237 A 2/1996 Geib et al. ..... 453/12
5,500,514 A 3/1996 Veeneman et al.
5,501,631 A 3/1996 Mennie et al. ..... 453/3
5,507,379 A 4/1996 Mazur et al. ..... 194/318
D369,984 S 5/1996 Larsen ..... D10/97
5,514,034 A 5/1996 Jones et al. ..... 453/10
5,520,577 A 5/1996 Rasmussen ..... 453/56
5,538,468 A 7/1996 Ristvedt et al. ..... 453/3
5,542,880 A 8/1996 Geib et al. ..... 453/10
5,542,881 A 8/1996 Geib ..... 453/10
5,553,320 A 9/1996 Matsuura et al.
5,559,887 A 9/1996 Davis et al.
5,564,546 A 10/1996 Molbak et al.
5,564,974 A 10/1996 Mazur et al. ..... 453/10
5,564,978 A 10/1996 Jones et al. ..... 453/17
5,570,465 A 10/1996 Tsakanikas
5,573,457 A 11/1996 Watts et al. ..... 453/31
5,584,758 A 12/1996 Geib ..... 453/10
5,592,377 A 1/1997 Lipkin
5,602,933 A 2/1997 Blackwell et al.
5,620,079 A * 4/1997 Molbak ..... 194/217
5,625,562 A 4/1997 Veeneman et al.
5,630,494 A 5/1997 Strauts ..... 194/317
5,633,949 A 5/1997 Graves et al. ..... 382/135
5,640,463 A 6/1997 Csulits ..... 382/135
5,641,050 A 6/1997 Smith et al.
5,650,605 A 7/1997 Morioka et al.
5,652,421 A 7/1997 Veeneman et al.
5,652,802 A 7/1997 Graves et al. ..... 382/135
5,679,070 A 10/1997 Ishida et al.
5,687,963 A 11/1997 Mennie ..... 271/119
5,692,067 A 11/1997 Raterman et al. ..... 382/135
5,704,491 A 1/1998 Graves ..... 209/534
5,724,438 A 3/1998 Graves ..... 382/135
5,743,373 A 4/1998 Strauts ..... 194/318
5,746,299 A 5/1998 Molbak et al.
5,751,840 A 5/1998 Raterman et al. ..... 382/135
5,774,874 A 6/1998 Veeneman et al.
5,782,686 A 7/1998 Geib et al. ..... 453/10
5,790,693 A 8/1998 Graves et al. ..... 382/135
5,790,697 A 8/1998 Munro et al. ..... 382/135
5,797,126 A * 8/1998 Helbling et al. ..... 705/5
5,799,767 A 9/1998 Molbak
5,806,650 A 9/1998 Mennie et al. ..... 194/206
5,813,510 A 9/1998 Rademacher
5,815,592 A 9/1998 Mennie et al. ..... 382/135
5,822,448 A 10/1998 Graves et al. ..... 382/135
5,830,054 A 11/1998 Petri
5,832,104 A 11/1998 Graves et al. ..... 382/135
5,842,188 A 11/1998 Ramsey et al.
5,842,916 A 12/1998 Gerrity et al.
5,850,076 A 12/1998 Morioka et al.
5,854,581 A 12/1998 Mori et al.
5,865,673 A 2/1999 Geib et al. ..... 453/10
5,867,589 A 2/1999 Graves et al. ..... 382/135
5,870,487 A 2/1999 Graves et al. ..... 382/135
5,875,259 A 2/1999 Mennie et al. ..... 382/135
5,880,444 A 3/1999 Shibata et al.
5,892,211 A 4/1999 Davis et al.
5,892,827 A 4/1999 Beach et al.
5,905,810 A 5/1999 Jones et al. ..... 382/135
5,909,502 A 6/1999 Mazur ..... 382/135
5,909,503 A 6/1999 Graves et al. ..... 382/135
5,909,793 A 6/1999 Beach et al.
5,909,794 A 6/1999 Molbak et al.
5,912,982 A 6/1999 Munro et al. ..... 382/135
5,913,399 A 6/1999 Takemoto et al.
5,918,748 A 7/1999 Clark et al.
5,938,044 A 8/1999 Weggesser ..... 209/534
5,940,623 A 8/1999 Watts et al. ..... 395/712
5,943,655 A 8/1999 Jacobsen ..... 705/30
5,944,600 A 8/1999 Zimmermann
5,951,476 A 9/1999 Beach et al.
5,957,262 A 9/1999 Molbak et al.
5,960,103 A 9/1999 Graves et al. ..... 382/135
5,966,456 A 10/1999 Jones et al. ..... 382/135
5,982,918 A 11/1999 Mennie et al. ..... 382/135
5,988,348 A 11/1999 Martin et al.
5,992,601 A 11/1999 Mennie et al. ..... 194/207
5,995,949 A 11/1999 Morioka et al.
5,997,395 A 12/1999 Geib et al. ..... 453/10
6,012,565 A 1/2000 Mazur ..... 194/207
6,017,270 A 1/2000 Ristvedt et al.
6,021,883 A 2/2000 Casanova et al. ..... 194/217
6,026,175 A 2/2000 Munro et al. ..... 382/135
6,028,951 A 2/2000 Raterman et al. ..... 382/135
6,032,859 A 3/2000 Muehlberger et al.
6,039,644 A 3/2000 Geib et al. ..... 453/10
6,039,645 A 3/2000 Mazur ..... 453/10
6,042,470 A 3/2000 Geib et al. ..... 453/10
6,047,807 A 4/2000 Molbak
6,047,808 A 4/2000 Neubarth et al.
6,056,104 A 5/2000 Neubarth et al.
6,068,194 A 5/2000 Mazur ..... 235/492
6,072,896 A 6/2000 Graves et al. ..... 382/135
6,073,744 A 6/2000 Raterman et al. ..... 194/207
6,074,334 A 6/2000 Mennie et al. ..... 493/438
6,080,056 A 6/2000 Karlsson
6,082,519 A 7/2000 Martin et al.
6,086,471 A 7/2000 Zimmermann
6,095,313 A 8/2000 Molbak et al.
6,116,402 A 9/2000 Beach et al.
6,128,402 A 10/2000 Jones et al. ..... 382/135
6,131,625 A 10/2000 Casanova et al. ..... 141/314
6,139,418 A 10/2000 Geib et al. ..... 453/10
6,145,738 A 11/2000 Stinson et al.
6,168,001 B1 1/2001 Davis
6,171,182 B1 1/2001 Geib et al. ..... 453/10
6,174,230 B1 1/2001 Gerrity et al.
6,196,371 B1 3/2001 Martin et al.
6,196,913 B1 3/2001 Geib et al. ..... 453/10
6,220,419 B1 4/2001 Mennie ..... 194/207
6,230,928 B1 5/2001 Hanna et al.
6,237,739 B1 5/2001 Mazur et al. ..... 194/207
6,241,069 B1 6/2001 Mazur et al. ..... 194/207
6,256,407 B1 7/2001 Mennie et al. ..... 382/135
6,278,795 B1 8/2001 Anderson et al. ..... 382/135
6,308,887 B1 10/2001 Korman et al.
6,311,819 B1 11/2001 Stromme et al. ..... 194/207
6,318,536 B1 11/2001 Korman et al.
6,318,537 B1 11/2001 Jones et al. ..... 194/346
6,351,551 B1 2/2002 Munro et al. ..... 382/135
6,363,164 B1 3/2002 Jones et al. ..... 382/135
6,371,303 B1 4/2002 Klein et al. ..... 209/534
6,378,683 B2 4/2002 Mennie ..... 194/207
6,381,354 B1 4/2002 Mennie et al. ..... 382/135
6,398,000 B1 6/2002 Jenrick et al. ..... 194/200
6,438,230 B1 8/2002 Moore
6,456,928 B1 9/2002 Johnson
6,459,806 B1 10/2002 Raterman et al. ..... 382/135
6,460,705 B1 10/2002 Hallowell ..... 209/534
6,471,030 B1 10/2002 Neubarth et al.
6,474,548 B1 11/2002 Montross et al.
6,484,863 B1 11/2002 Molbak
6,484,884 B1 11/2002 Gerrity et al.
6,493,461 B1 12/2002 Mennie et al. ..... 382/135
6,494,776 B1 12/2002 Molbak
6,499,277 B1 12/2002 Warner et al. ..... 53/447
6,520,308 B1 2/2003 Martin et al.
6,539,104 B1 3/2003 Raterman et al. ..... 382/135
6,547,131 B1 4/2003 Foodman et al.
6,552,781 B1 4/2003 Rompel et al.
6,554,185 B1 4/2003 Montross et al.
6,560,355 B2 5/2003 Graves et al. ..... 382/135
6,579,165 B2 6/2003 Kuhlin et al. ..... 453/3
6,588,569 B1 7/2003 Jenrick et al. ..... 194/206
6,601,687 B1 8/2003 Jenrick et al. ..... 194/206
6,602,125 B2 8/2003 Martin
6,603,872 B2 8/2003 Jones et al. ..... 382/135
6,609,604 B1 8/2003 Jones et al. ..... 194/302
6,612,921 B2 9/2003 Geib et al. ..... 453/13
6,621,919 B2 9/2003 Mennie et al. ..... 382/135

6,628,816 B2 9/2003 Mennie et al. ..... 382/135
6,636,624 B2 10/2003 Raterman et al. ..... 382/135
6,637,576 B1 10/2003 Jones et al. ..... 194/216
6,647,136 B2 11/2003 Jones et al. ..... 382/137
6,650,767 B2 11/2003 Jones et al. ..... 382/135
6,654,486 B2 11/2003 Jones et al. ..... 382/135
6,661,910 B2 12/2003 Jones et al. ..... 382/135
6,663,675 B2 12/2003 Blake et al. ..... 753/63
6,665,431 B2 12/2003 Jones et al. ..... 382/135
6,666,318 B2 12/2003 Gerrity et al.
6,678,401 B2 1/2004 Jones et al. ..... 382/135
6,678,402 B2 1/2004 Jones et al. ..... 382/135
6,705,470 B2 3/2004 Klein et al. ..... 209/534
6,721,442 B1 4/2004 Mennie et al. ..... 382/135
6,724,926 B2 4/2004 Jones et al. ..... 382/135
6,724,927 B2 4/2004 Jones et al. ..... 382/135
6,731,785 B1 5/2004 Mennie et al. ..... 382/135
6,731,786 B2 5/2004 Jones et al. ..... 382/135
6,748,101 B1 6/2004 Jones et al. ..... 382/135
6,755,730 B2 6/2004 Blake et al. ..... 453/3
6,758,316 B2 7/2004 Molbak
6,766,892 B2 7/2004 Martin et al.
6,778,693 B2 8/2004 Jones et al. ..... 382/135
6,783,452 B2 8/2004 Hino et al.
6,783,785 B1 8/2004 Raghavan et al.
6,786,398 B1 9/2004 Stinson et al.
6,798,899 B2 9/2004 Mennie et al. ..... 382/135
6,810,137 B2 10/2004 Jones et al. ..... 382/135
6,843,418 B2 1/2005 Jones et al. ..... 235/462.01
6,854,581 B2 2/2005 Molbak
6,854,640 B2 2/2005 Peklo ..... 235/100
6,860,375 B2 3/2005 Hallowell et al. ..... 194/328
6,863,168 B1 3/2005 Gerrity et al.
6,866,134 B2 3/2005 Stromme et al. ..... 194/207
6,868,954 B2 3/2005 Stromme et al. ..... 194/207
6,880,692 B1 4/2005 Mazur et al. ..... 194/207
6,892,871 B2 5/2005 Strauts et al. ..... 194/302
6,896,118 B2 5/2005 Jones et al. ..... 194/217
6,913,130 B1 7/2005 Mazur et al. ..... 194/207
6,913,260 B2 7/2005 Maier et al. ..... 271/265.04
6,915,893 B2 7/2005 Mennie ..... 194/207
6,929,109 B1 8/2005 Klein et al. ..... 194/206
6,953,150 B2 10/2005 Shepley et al.
6,955,253 B1 10/2005 Mazur et al. ..... 194/207
6,957,733 B2 10/2005 Mazur et al. ..... 194/215
6,959,800 B1 11/2005 Mazur et al. ..... 194/207
6,962,247 B2 11/2005 Maier et al. ..... 194/207
6,966,417 B2 11/2005 Peklo et al. ..... 194/344
6,976,570 B2 * 12/2005 Molbak ..... 194/215
6,980,684 B1 12/2005 Munro et al. ..... 382/135
6,988,606 B2 1/2006 Geib et al. ..... 194/334
6,991,530 B2 1/2006 Hino et al.
6,994,200 B2 2/2006 Jenrick et al. ..... 194/206
6,996,263 B2 2/2006 Jones et al. ..... 382/135
7,000,828 B2 2/2006 Jones ..... 235/379
7,004,831 B2 2/2006 Hino et al.
7,014,029 B2 3/2006 Winters
7,016,767 B2 3/2006 Jones et al. ..... 700/224
7,017,729 B2 3/2006 Gerrity et al.
7,018,286 B2 3/2006 Blake et al. ..... 453/61
7,028,827 B1 4/2006 Molbak et al.
7,036,651 B2 5/2006 Tam et al. ..... 194/217
7,082,216 B2 7/2006 Jones et al. ..... 382/137
7,083,036 B2 8/2006 Adams
7,092,560 B2 8/2006 Jones et al. ..... 382/135
7,103,206 B2 9/2006 Graves et al. ..... 382/135
7,103,438 B2 9/2006 Hallowell et al. ..... 700/116
7,110,981 B1 * 9/2006 Sidikman et al. ..... 705/43
7,113,929 B1 9/2006 Beach et al.
7,131,580 B2 11/2006 Molbak
7,146,245 B2 12/2006 Jones et al. ..... 700/224
7,149,336 B2 12/2006 Jones et al. ..... 382/135
7,158,662 B2 1/2007 Chiles ..... 382/135
7,171,032 B2 1/2007 Jones et al. ..... 382/135
7,187,795 B2 3/2007 Jones et al. ..... 382/135
7,188,720 B2 3/2007 Geib et al. ..... 194/302
7,191,657 B2 3/2007 Maier et al. ..... 73/587
7,197,173 B2 3/2007 Jones et al. ..... 382/135
7,200,255 B2 4/2007 Jones et al. ..... 382/135
7,201,320 B2 4/2007 Csulits et al. ..... 235/462.01
7,213,697 B2 5/2007 Martin et al.
7,232,024 B2 6/2007 Mazur et al. ..... 194/207
7,243,773 B2 7/2007 Bochonok et al. ..... 194/350
7,248,731 B2 7/2007 Raterman et al. ..... 382/135
7,256,874 B2 8/2007 Csulits et al. ..... 356/71
7,269,279 B2 9/2007 Chiles ..... 382/135
7,290,705 B1 11/2007 Shin ..... 235/385
7,303,119 B2 12/2007 Molbak
7,331,521 B2 2/2008 Sorenson et al.
7,337,890 B2 3/2008 Bochonok et al. ..... 194/353
7,349,566 B2 3/2008 Jones et al. ..... 382/139
7,362,891 B2 4/2008 Jones et al. ..... 382/135
7,366,338 B2 4/2008 Jones et al. ..... 382/135
7,391,897 B2 6/2008 Jones et al. ..... 382/135
7,427,230 B2 9/2008 Blake et al. ..... 453/63
7,438,172 B2 10/2008 Long et al. ..... 194/347
7,464,802 B2 12/2008 Gerrity et al.
7,505,831 B2 3/2009 Jones et al. ..... 700/224
7,520,374 B2 4/2009 Martin et al.
7,536,046 B2 5/2009 Raterman et al. ..... 382/135
7,542,598 B2 6/2009 Jones et al. ..... 382/135
7,551,764 B2 6/2009 Chiles et al. ..... 382/135
7,552,810 B2 6/2009 Mecklenburg ..... 194/317
7,580,859 B2 8/2009 Economy
7,590,274 B2 9/2009 Raterman et al. ..... 382/135
7,591,428 B2 9/2009 Freeman et al. ..... 235/449
7,599,543 B2 10/2009 Jones et al. ..... 382/137
7,600,626 B2 10/2009 Hallowell et al. ..... 194/206
7,602,956 B2 10/2009 Jones et al. ..... 382/135
7,619,721 B2 11/2009 Jones et al. ..... 356/71
7,620,231 B2 11/2009 Jones et al. ..... 382/137
7,624,914 B2 * 12/2009 Brumfield et al. ..... 232/7
7,628,326 B2 12/2009 Freeman et al. ..... 235/450
7,635,082 B2 12/2009 Jones ..... 235/379
7,654,450 B2 2/2010 Mateen et al.
7,658,270 B2 2/2010 Bochonok et al. ..... 194/350
7,743,902 B2 6/2010 Wendell et al. ..... 194/302
7,778,456 B2 8/2010 Jones et al. ..... 382/135
7,874,478 B2 1/2011 Molbak
7,886,890 B2 2/2011 Blake et al. ..... 194/347
7,931,304 B2 4/2011 Brown et al.
2001/0006557 A1 7/2001 Mennie et al. ..... 382/135
2001/0015311 A1 8/2001 Mennie ..... 194/207
2001/0019624 A1 9/2001 Raterman et al. ..... 382/135
2001/0034203 A1 10/2001 Geib et al. ..... 453/3
2001/0035603 A1 11/2001 Graves et al. ..... 271/265.01
2002/0001393 A1 1/2002 Jones et al. ..... 382/100
2002/0020603 A1 2/2002 Jones et al. ..... 194/346
2002/0056605 A1 5/2002 Mazur et al. ..... 194/207
2002/0065033 A1 5/2002 Geib et al. ..... 453/3
2002/0069104 A1 6/2002 Beach et al.
2002/0085245 A1 7/2002 Mennie et al. ..... 358/498
2002/0085745 A1 7/2002 Jones et al. ..... 382/135
2002/0103757 A1 8/2002 Jones et al. ..... 705/45
2002/0104785 A1 8/2002 Klein et al. ..... 209/534
2002/0107738 A1 8/2002 Beach et al.
2002/0107801 A1 8/2002 Jones et al. ..... 705/45
2002/0118871 A1 8/2002 Jones et al. ..... 382/137
2002/0122580 A1 9/2002 Jones et al. ..... 382/137
2002/0126885 A1 9/2002 Mennie et al. ..... 382/135
2002/0126886 A1 9/2002 Jones et al. ..... 382/135
2002/0130011 A1 9/2002 Casanova et al. ..... 194/344
2002/0131630 A1 9/2002 Jones et al. ..... 382/137
2002/0136442 A1 9/2002 Jones et al. ..... 382/135
2002/0145035 A1 10/2002 Jones ..... 235/379
2002/0151267 A1 10/2002 Kuhlin et al. ..... 453/3
2002/0154804 A1 10/2002 Jones et al. ..... 382/135
2002/0154805 A1 10/2002 Jones et al. ..... 382/135
2002/0154806 A1 10/2002 Jones et al. ..... 382/135
2002/0154807 A1 10/2002 Jones et al. ..... 382/135
2002/0154808 A1 10/2002 Jones et al. ..... 382/135
2002/0179401 A1 12/2002 Knox et al.
2002/0186876 A1 12/2002 Jones et al. ..... 382/135
2003/0004878 A1 1/2003 Akutsu et al.
2003/0009420 A1 1/2003 Jones ..... 705/39
2003/0013403 A1 1/2003 Blake et al. ..... 453/60
2003/0015395 A1 1/2003 Hallowell et al. ..... 194/206
2003/0015396 A1 1/2003 Mennie ..... 194/206

| | | | | |
|---|---|---|---|---|
| 2003/0059098 | A1 | 3/2003 | Jones et al. | 382/135 |
| 2003/0062242 | A1 | 4/2003 | Hallowell et al. | 194/302 |
| 2003/0081824 | A1 | 5/2003 | Mennie et al. | 382/135 |
| 2003/0108233 | A1 | 6/2003 | Raterman et al. | 382/135 |
| 2003/1277299 | | 6/2003 | Jones et al. | |
| 2003/0121752 | A1 | 7/2003 | Stromme et al. | 194/207 |
| 2003/0121753 | A1 | 7/2003 | Stromme et al. | 194/207 |
| 2003/0127299 | A1 | 7/2003 | Jones et al. | 194/217 |
| 2003/0132281 | A1 | 7/2003 | Jones et al. | 235/379 |
| 2003/0139994 | A1 | 7/2003 | Jones | 705/36 |
| 2003/0168308 | A1 | 9/2003 | Maier et al. | 194/207 |
| 2003/0168309 | A1 | 9/2003 | Geib et al. | 194/302 |
| 2003/0168310 | A1 | 9/2003 | Strauts et al. | 194/302 |
| 2003/0174874 | A1 | 9/2003 | Raterman et al. | 382/135 |
| 2003/0182217 | A1 | 9/2003 | Chiles | 705/35 |
| 2003/0190882 | A1 | 10/2003 | Blake et al. | 453/63 |
| 2003/0198373 | A1 | 10/2003 | Raterman et al. | 382/135 |
| 2003/0200180 | A1 | 10/2003 | Phelan, III et al. | 705/65 |
| 2003/0234153 | A1 | 12/2003 | Blake et al. | 194/347 |
| 2004/0003980 | A1 | 1/2004 | Hallowell et al. | 194/206 |
| 2004/0016621 | A1 | 1/2004 | Jenrick et al. | 194/206 |
| 2004/0016797 | A1 | 1/2004 | Jones et al. | 235/379 |
| 2004/0028266 | A1 | 2/2004 | Jones et al. | 382/135 |
| 2004/0055902 | A1 | 3/2004 | Peklo | 206/0.815 |
| 2004/0083149 | A1 | 4/2004 | Jones | 705/35 |
| 2004/0092222 | A1 | 5/2004 | Kowalczyk et al. | 453/12 |
| 2004/0099730 | A1 | 5/2004 | Tuchler et al. | 235/38 |
| 2004/0145726 | A1 | 7/2004 | Csulits et al. | 356/71 |
| 2004/0149538 | A1 | 8/2004 | Sakowski | 194/207 |
| 2004/0153406 | A1 | 8/2004 | Luther et al. | |
| 2004/0153408 | A1 | 8/2004 | Jones et al. | 705/43 |
| 2004/0154899 | A1 | 8/2004 | Peklo et al. | 193/33 |
| 2004/0154964 | A1 | 8/2004 | Jones | 209/534 |
| 2004/0173432 | A1 | 9/2004 | Jones | 194/216 |
| 2004/0188221 | A1 | 9/2004 | Carter | |
| 2004/0200691 | A1 | 10/2004 | Geib et al. | 194/302 |
| 2004/0251110 | A1 | 12/2004 | Jenrick et al. | 194/207 |
| 2004/0256197 | A1 | 12/2004 | Blake et al. | 194/350 |
| 2005/0006197 | A1 | 1/2005 | Wendell et al. | 194/302 |
| 2005/0029168 | A1 | 2/2005 | Jones et al. | 209/534 |
| 2005/0035034 | A1 | 2/2005 | Long et al. | 209/534 |
| 2005/0040007 | A1 | 2/2005 | Geib et al. | 194/302 |
| 2005/0040225 | A1 | 2/2005 | Csulits et al. | 235/379 |
| 2005/0045450 | A1 | 3/2005 | Geib et al. | 194/318 |
| 2005/0047642 | A1 | 3/2005 | Jones et al. | 382/137 |
| 2005/0060055 | A1 | 3/2005 | Hallowell et al. | 700/95 |
| 2005/0060059 | A1 | 3/2005 | Klein et al. | 700/213 |
| 2005/0060061 | A1 | 3/2005 | Jones | 700/226 |
| 2005/0067305 | A1 | 3/2005 | Bochonok et al. | 206/8 |
| 2005/0077142 | A1 | 4/2005 | Tam et al. | 194/217 |
| 2005/0086271 | A1 | 4/2005 | Jones et al. | 707/200 |
| 2005/0087422 | A1 | 4/2005 | Maier et al. | 194/207 |
| 2005/0087425 | A1 | 4/2005 | Peklo | 194/350 |
| 2005/0108165 | A1 | 5/2005 | Jones et al. | 705/43 |
| 2005/0117791 | A2 | 6/2005 | Raterman et al. | 382/135 |
| 2005/0117792 | A2 | 6/2005 | Graves et al. | 382/135 |
| 2005/0150738 | A1 | 7/2005 | Hallowell et al. | 194/206 |
| 2005/0163361 | A1 | 7/2005 | Jones et al. | 382/135 |
| 2005/0163362 | A1 | 7/2005 | Jones et al. | 382/137 |
| 2005/0169511 | A1 | 8/2005 | Jones | 382/135 |
| 2005/0173221 | A1 | 8/2005 | Maier et al. | 194/207 |
| 2005/0183928 | A1 | 8/2005 | Jones et al. | 194/207 |
| 2005/0207634 | A1 | 9/2005 | Jones et al. | 382/135 |
| 2005/0213803 | A1 | 9/2005 | Mennie et al. | 382/135 |
| 2005/0228717 | A1 | 10/2005 | Gusler et al. | |
| 2005/0241909 | A1 | 11/2005 | Mazur et al. | 194/207 |
| 2005/0249394 | A1 | 11/2005 | Jones et al. | 382/135 |
| 2005/0256792 | A1 | 11/2005 | Shimizu et al. | |
| 2005/0265591 | A1 | 12/2005 | Jones et al. | 382/135 |
| 2005/0276458 | A1 | 12/2005 | Jones et al. | 382/135 |
| 2005/0278239 | A1 | 12/2005 | Jones et al. | 705/35 |
| 2006/0010071 | A1 | 1/2006 | Jones et al. | 705/42 |
| 2006/0054455 | A1 | 3/2006 | Kuykendall et al. | 194/217 |
| 2006/0054457 | A1 | 3/2006 | Long et al. | 194/347 |
| 2006/0064379 | A1 | 3/2006 | Doran et al. | |
| 2006/0069654 | A1 | 3/2006 | Beach | |
| 2006/0078186 | A1 | 4/2006 | Freeman et al. | 382/135 |
| 2006/0148394 | A1 | 7/2006 | Blake et al. | 453/12 |
| 2006/0149415 | A1 | 7/2006 | Richards | |
| 2006/0151285 | A1 | 7/2006 | String | |
| 2006/0154589 | A1 | 7/2006 | String | |
| 2006/0175176 | A1 | 8/2006 | Blake | 194/216 |
| 2006/0182330 | A1 | 8/2006 | Chiles | 382/135 |
| 2006/0195567 | A1 | 8/2006 | Mody et al. | 709/224 |
| 2006/0196754 | A1 | 9/2006 | Bochonok et al. | 194/347 |
| 2006/0205481 | A1 | 9/2006 | Dominelli | |
| 2006/0207856 | A1* | 9/2006 | Dean et al. | 194/302 |
| 2006/0210137 | A1 | 9/2006 | Raterman et al. | 382/135 |
| 2006/0218038 | A1 | 9/2006 | Grider | 705/14 |
| 2006/0219519 | A1 | 10/2006 | Molbak | |
| 2006/0274929 | A1 | 12/2006 | Jones et al. | 382/135 |
| 2006/0283685 | A1 | 12/2006 | Cousin | |
| 2007/0017776 | A1* | 1/2007 | Warren | 194/217 |
| 2007/0051582 | A1 | 3/2007 | Bochonok et al. | 194/202 |
| 2007/0071302 | A1 | 3/2007 | Jones et al. | 382/135 |
| 2007/0076939 | A1 | 4/2007 | Jones et al. | 382/135 |
| 2007/0078560 | A1 | 4/2007 | Jones et al. | 700/224 |
| 2007/0095630 | A1 | 5/2007 | Mennie et al. | 194/206 |
| 2007/0108015 | A1 | 5/2007 | Bochonok et al. | 194/350 |
| 2007/0112674 | A1 | 5/2007 | Jones et al. | 705/45 |
| 2007/0119681 | A1 | 5/2007 | Blake et al. | 194/215 |
| 2007/0122023 | A1 | 5/2007 | Jenrick et al. | 382/135 |
| 2007/0172107 | A1 | 7/2007 | Jones et al. | 382/137 |
| 2007/0181676 | A1 | 8/2007 | Mateen et al. | 235/381 |
| 2007/0187494 | A1 | 8/2007 | Hanna | |
| 2007/0209904 | A1 | 9/2007 | Freeman et al. | 194/210 |
| 2007/0221470 | A1 | 9/2007 | Mennie et al. | 194/216 |
| 2007/0237381 | A1 | 10/2007 | Mennie et al. | 382/135 |
| 2007/0258633 | A1 | 11/2007 | Jones et al. | 382/135 |
| 2007/0269097 | A1 | 11/2007 | Chiles et al. | 382/135 |
| 2007/0278064 | A1 | 12/2007 | Hallowell et al. | 194/206 |
| 2008/0006505 | A1 | 1/2008 | Renz et al. | 194/206 |
| 2008/0033829 | A1 | 2/2008 | Mennie et al. | 705/16 |
| 2008/0044077 | A1 | 2/2008 | Mennie et al. | 382/135 |
| 2008/0060906 | A1 | 3/2008 | Fitzgerald et al. | 194/207 |
| 2008/0123932 | A1 | 5/2008 | Jones et al. | 382/135 |
| 2008/0133411 | A1 | 6/2008 | Jones et al. | 705/42 |
| 2008/0177420 | A1 | 7/2008 | Klein et al. | 700/224 |
| 2008/0219543 | A1 | 9/2008 | Csultis et al. | 382/135 |
| 2008/0220707 | A1 | 9/2008 | Jones et al. | 453/2 |
| 2008/0285838 | A1 | 11/2008 | Jones et al. | 382/135 |
| 2009/0001661 | A1 | 1/2009 | Klein et al. | 271/258.01 |
| 2009/0018959 | A1 | 1/2009 | Doran | |
| 2009/0022390 | A1 | 1/2009 | Yacoubian et al. | 382/135 |
| 2009/0087076 | A1 | 4/2009 | Jenrick | 382/135 |
| 2009/0090779 | A1 | 4/2009 | Freeman | 235/450 |
| 2009/0236200 | A1 | 9/2009 | Hallowell et al. | 194/215 |
| 2009/0236201 | A1 | 9/2009 | Blake et al. | 194/215 |
| 2009/0239459 | A1 | 9/2009 | Watts et al. | 453/18 |
| 2009/0242626 | A1 | 10/2009 | Jones et al. | 235/379 |
| 2009/0320106 | A1 | 12/2009 | Jones et al. | 726/5 |
| 2010/0038419 | A1 | 2/2010 | Blake et al. | 235/379 |
| 2010/0198726 | A1 | 8/2010 | Doran et al. | |
| 2010/0261421 | A1 | 10/2010 | Wendell et al. | 453/4 |
| 2010/0276485 | A1 | 11/2010 | Jones et al. | 235/379 |
| 2010/0327005 | A1 | 12/2010 | Martin et al. | |
| 2011/0098845 | A1 | 4/2011 | Mennie et al. | 700/223 |
| 2011/0099105 | A1 | 4/2011 | Mennie et al. | 705/41 |

FOREIGN PATENT DOCUMENTS

| | | |
|---|---|---|
| CA | 2 143 943 | 3/2003 |
| DE | 06 60 354 | 5/1938 |
| DE | 30 21 327 | 12/1981 |
| EP | 0 351 217 | 1/1990 |
| EP | 0 667 973 | 1/1997 |
| EP | 0 926 634 | 6/1999 |
| EP | 1 209 639 | 5/2002 |
| EP | 1528513 | 5/2005 |
| EP | 1413995 | 4/2010 |
| FR | 2042254 | 2/1971 |
| GB | 2 035 642 | 6/1980 |
| GB | 2 175 427 | 11/1986 |
| GB | 2 198 274 | 6/1988 |
| GB | 2 458 387 | 9/2009 |
| GB | 2468783 A | 9/2010 |
| JP | 49/58899 | 6/1974 |
| JP | 52/014495 | 2/1977 |
| JP | 05/271300 | 6/1977 |

| | | | |
|---|---|---|---|
| JP | 05/640992 | | 4/1981 |
| JP | 57/117080 | | 7/1982 |
| JP | 59/79392 | | 8/1984 |
| JP | 06/016271 | | 2/1985 |
| JP | 50/158343 | | 12/1985 |
| JP | 62/134168 | | 8/1987 |
| JP | 62/182995 | | 8/1987 |
| JP | 62/221773 | | 9/1987 |
| JP | 62/166562 | | 10/1987 |
| JP | 64/042789 | | 2/1989 |
| JP | 64/067698 | | 3/1989 |
| JP | 01/118995 | | 5/1989 |
| JP | 64/035683 | | 6/1989 |
| JP | 1/307891 | | 12/1989 |
| JP | 02/050793 | | 2/1990 |
| JP | 02/252096 | | 10/1990 |
| JP | 03/012776 | | 1/1991 |
| JP | 3/63795 | | 3/1991 |
| JP | 3/92994 | | 4/1991 |
| JP | 03/156673 | | 7/1991 |
| JP | 04/085695 | | 3/1992 |
| JP | 41/75993 | | 6/1992 |
| JP | 05/274527 | | 10/1993 |
| JP | 06/035946 | | 2/1994 |
| JP | 06/103285 | | 4/1994 |
| JP | 09/251566 | | 9/1997 |
| JP | 20020/117439 | | 4/2002 |
| JP | 2003/242287 | | 8/2003 |
| JP | 2004/213188 | | 7/2004 |
| WO | 85/00909 | | 2/1985 |
| WO | WO 91/06927 | A1 | 5/1991 |
| WO | WO 91/08952 | A1 | 6/1991 |
| WO | WO 91/11778 | | 8/1991 |
| WO | WO 91/12594 | A1 | 8/1991 |
| WO | WO 91/18371 | A1 | 11/1991 |
| WO | WO 92/08212 | A1 | 5/1992 |
| WO | WO 92/17394 | | 10/1992 |
| WO | WO 92/20043 | A1 | 11/1992 |
| WO | WO 92/20044 | A1 | 11/1992 |
| WO | WO 92/22044 | A1 | 12/1992 |
| WO | WO 93/00660 | A1 | 1/1993 |
| WO | 93/09621 | | 5/1993 |
| WO | WO 93/23824 | | 11/1993 |
| WO | 94/06101 | | 3/1994 |
| WO | WO 94/08319 | A1 | 4/1994 |
| WO | WO 94/23397 | A1 | 10/1994 |
| WO | WO 95/02226 | A1 | 1/1995 |
| WO | WO 95/04978 | A1 | 2/1995 |
| WO | WO 95/06920 | A1 | 3/1995 |
| WO | WO 95/09406 | A1 | 4/1995 |
| WO | WO 95/13596 | A1 | 5/1995 |
| WO | WO 95/19017 | A1 | 7/1995 |
| WO | WO 95/23387 | A1 | 8/1995 |
| WO | WO 95/24691 | | 9/1995 |
| WO | WO 96/07163 | A1 | 3/1996 |
| WO | WO 96/07990 | A1 | 3/1996 |
| WO | WO 96/10800 | | 4/1996 |
| WO | WO 96/12253 | A1 | 4/1996 |
| WO | WO 96/27525 | A1 | 9/1996 |
| WO | WO 96/27859 | A1 | 9/1996 |
| WO | WO 96/36933 | | 11/1996 |
| WO | WO 97/30422 | | 8/1997 |
| WO | WO 97/43734 | | 11/1997 |
| WO | WO 97/45810 | | 12/1997 |
| WO | WO 98/12662 | | 3/1998 |
| WO | WO 98/13785 | | 4/1998 |
| WO | 98/24041 | | 6/1998 |
| WO | WO 98/24052 | | 6/1998 |
| WO | WO 98/24067 | | 6/1998 |
| WO | WO 98/24067 | A1 | 6/1998 |
| WO | WO 98/35323 | | 8/1998 |
| WO | WO 98/40839 | | 9/1998 |
| WO | 98/48383 | | 10/1998 |
| WO | 98/48384 | | 10/1998 |
| WO | 98/48385 | | 10/1998 |
| WO | WO 98/47100 | | 10/1998 |
| WO | 98/51082 | | 11/1998 |
| WO | WO 98/50892 | | 11/1998 |
| WO | WO 98/59323 | | 12/1998 |
| WO | WO 98/59323 | A1 | 12/1998 |
| WO | 99/00776 | | 1/1999 |
| WO | WO 99/06937 | A1 | 2/1999 |
| WO | WO 99/09511 | | 2/1999 |
| WO | WO 99/14668 | | 3/1999 |
| WO | WO 99/23601 | | 5/1999 |
| WO | 99/33030 | | 7/1999 |
| WO | 99/41695 | | 8/1999 |
| WO | WO 99/41695 | | 8/1999 |
| WO | WO 99/48040 | | 9/1999 |
| WO | WO 99/48042 | | 9/1999 |
| WO | WO 99/48057 | A1 | 9/1999 |
| WO | WO 99/48058 | A1 | 9/1999 |
| WO | WO 00/24572 | | 5/2000 |
| WO | WO 00/48911 | A1 | 8/2000 |
| WO | WO 00/65546 | A1 | 11/2000 |
| WO | WO 01/08108 | | 2/2001 |
| WO | WO 01/59685 | | 8/2001 |
| WO | WO 01/59723 | | 8/2001 |
| WO | WO 01/63565 | A2 | 8/2001 |
| WO | WO 02/29735 | | 4/2002 |
| WO | WO 02/054360 | | 7/2002 |
| WO | WO 02/071343 | A1 | 9/2002 |
| WO | WO 03/005312 | | 1/2003 |
| WO | WO 03/028361 | | 4/2003 |
| WO | WO 03/029913 | | 4/2003 |
| WO | WO 03/030113 | | 4/2003 |
| WO | 03/052700 | | 6/2003 |
| WO | WO 03/052700 | A3 | 6/2003 |
| WO | WO 03/067532 | | 8/2003 |
| WO | WO 03/079300 | A1 | 9/2003 |
| WO | WO 03/085610 | A1 | 10/2003 |
| WO | WO 03/107280 | A2 | 12/2003 |
| WO | WO 03/107282 | | 12/2003 |
| WO | WO 2004/010367 | | 1/2004 |
| WO | WO 2004/027717 | | 4/2004 |
| WO | WO 2004/036508 | | 4/2004 |
| WO | WO 2004/038631 | | 5/2004 |
| WO | WO 2004/044853 | A1 | 5/2004 |
| WO | WO 2004/068422 | | 8/2004 |
| WO | WO 2004/109464 | A3 | 12/2004 |
| WO | WO 2004109464 | A2 | 12/2004 |
| WO | WO 2005/013209 | A2 | 2/2005 |
| WO | WO 2005/017842 | A1 | 2/2005 |
| WO | WO 2005/028348 | A2 | 3/2005 |
| WO | WO 2005/029240 | A2 | 3/2005 |
| WO | WO 2005/036445 | A1 | 4/2005 |
| WO | WO 2005/041134 | A2 | 5/2005 |
| WO | WO 2005/076229 | A1 | 8/2005 |
| WO | WO 2005/088563 | A1 | 9/2005 |
| WO | WO2005098769 | | 10/2005 |
| WO | WO 2006/039439 | A2 | 4/2006 |
| WO | WO 2006/076289 | A2 | 7/2006 |
| WO | WO 2006/076634 | A2 | 7/2006 |
| WO | WO 2006/086531 | A1 | 8/2006 |
| WO | 2007/035420 | | 3/2007 |
| WO | WO 2007/044570 | A2 | 4/2007 |
| WO | WO 2007/120825 | A2 | 10/2007 |
| WO | WO 2007/143128 | A2 | 12/2007 |
| WO | WO 2008/030356 | A1 | 3/2008 |
| WO | WO 2008/112132 | A1 | 9/2008 |

OTHER PUBLICATIONS

Amiel Industries: AI-1500 'Pulsar' High Performance Sorting and Bagging Machine, 13 pages (date prior to Mar. 2, 2011).
AUI: Coinverter—"No More Lines . . . Self- Serve Cash-Out," by Cassius Elston, 1995 World Games Congress/Exposition Converter, 1 page (dated prior to 1995).
Brandt: System 930 Electric Counter/Sorter, 1 page (date prior to Mar. 2, 2011).
Brandt: 95 Series Coin Sorter Counter, 2 pages (1982).
Brandt: Mach 7 High-Speed Coin Sorter/Counter, 2 pages (1992).
Brandt: Model 1205 Coin Sorter Counter, 2 pages (1986).
Brandt: Model 1400 Coin Sorter/Counter, 2 pages (date prior to Mar. 2, 2011).
Brandt: Model 817 Automated Coin and Currency Ordering System, 2 pages (1983).
Brandt: Model 8904 Upfeed,- High Speed 4-Denomination Currency Dispenser, 2 pages (1989).

Brandt: Model 920/925 Counter, 2 pages (1982).
Brandt: Model 940-6 High Speed Sorter/Counter, 2 pages (date prior to Mar. 2, 2011).
Brandt: Model 952 Coin Sorter/Counter, 2 pages (date prior to Mar. 2, 2011).
Brandt: Model 954 Coin Sorter/Counter, 2 pages (date prior to Mar. 2, 2011).
Brandt: Model 957 Coin Sorter/Counter, 2 pages (date prior to Mar. 2, 2011).
Brandt: Model 958 Coin Sorter/Counter, 5 pages (© 1982).
Brandt: Model 960 High-Speed Coin Sorter & Counter, 2 pages (1984).
Brandt: Model 970 Coin Sorter and Counter, 2 pages (1983).
Brandt: System 945 High Speed Sorter, 2 pages (date prior to Mar. 2, 2011).
Brandt; Model 966 Microsort™ Coin Sorter and Counter, 4 pages, (1979).
Case ICC Limited: CDS Automated Receipt Giving Cash Deposit System, 3 pages (date prior to Mar. 2, 2011).
Cash, Martin: Newspaper Article "Bank Blends New Technology With Service," Winnipeg Free Press, 1 page (Sep. 4, 1992).
Childers Corporation: Computerized Sorter/Counter, "To coin an old adage, time is money . . . ,"3 pages (1981).
CTCoin: CDS602 Cash Deposit System, 1 page (date prior to Mar. 2, 2011).
Cummins: Jetsort Automated Money Processing System Vendors Love Jetsort 1page (date prior to Mar. 2, 2011).
Cummins: JetSort Model 1760 Coin Sorter Counter 1page (date prior to Mar. 2, 2011).
Cummins: JetSort® Models 1770 and 3000, Communication Package specification and operating instructions, 10 pages (date prior to Mar. 2, 2011).
Cummins: JetSort® Model 1701 With Jetstops Coinsorter Operating Instructions Manual (© 1984), 16 pages.
Cummins: JetSort Model CA700-01 Coin Sorter Counter Operating Instructions (© 1982), 14 pages.
Cummins: Jetsort Model 3000 Series Options Talking Jetsort 3000 1page (date prior to Mar. 2, 2011).
Cummins: JetSort® Model CA-750 Coin Sorter/Counter and CA-4050 JetCount currency counter, "Money Processing Made Easy," 2 pages (date prior to Mar. 2, 2011).
Cummins: The Universal Solution to All Coin and Currency Processing Needs (Form 13C1218 3-83), 1 page (date prior to Mar. 2, 2011).
Cummins: Jetsort Time for a Change—Be a Smashing Success 1 page, (date prior to Mar. 2, 2011).
Cummins: Jetsort Time for a Change—JetSort® vs Brandt X, 1 page, (date prior to Mar. 2, 2011).
Cummins: Jetsort, Time for a Change—No Coins Sorted After 3:00 or on Saturday, 1 page (date prior to Mar. 2, 2011).
Cummins: Jetsort, What do all these Banks have in Common, 3 pages (date prior to Mar. 2, 2011).
Cummins: JetSort® 700-01, Cummins Automated Money Systems (AMS) Case Study—First State Bank of Oregon, "JetSort® Gives Bank Coin Service Edge," 2 pages (date prior to Mar. 2, 2011).
Cummins: JetSort® 701, Cummins Automated Money Systems (AMS) Case Study—Convenco Vending, "High Speed Coin Sorter increases [] processing power at Convenco Vending," 1 page (date prior to Mar. 2, 2011).
Cummins: Jetsort Model 3200, Enhanced Elecrtronics for Jetsort 3200, 1page, (date prior to Mar. 2, 2011).
Cummins: JetSort® High Speed Coin Sorter &Counter, "CTOCS Ready" (Form 023-1365), 2 pages (date prior to Mar. 2, 2011).
Cummins: JetSort Model 3000, Sorts Counts 3000 Mixed Coins Per Min, 1page, (date prior to Mar. 2, 2011).
Cummins: JetSort® Model 1770, "JetSort® Speed and Accuracy, Now with Communications!", (Form 023-1272) 1 page (date prior to Mar. 2, 2011).
Cummins: JetSort® 700-01/CA-118 Coin Wrapper, Cummins Automated Money Systems (AMS) Case Study—University State Bank, "Cummins Money Processing System Boosts Teller Service at University State Bank," 2 pages (date prior to Mar. 2, 2011).
Cummins: Jetsort Model CA130XL Case Study Coin Sorter Counter Keeps Pace With Fith Third Bank, 2pages (date prior to Mar. 2, 2011).
Cummins: Jetsort One Moving Part Simplicity Vendors Are Validators Changing Your Coin/Currency 3pages (date prior to Mar. 2, 2011).
Cummins: JetSort Model Series V, High Speed Coin Sorter Counter, 2pages (date prior to Mar. 2, 2011).
Cummins: JetSort Models 701 and 750 , "State-of-the-art coin processing comes of age," 2 pages (Feb. 1984).
Cummins: Jetsort Cash Information and Settlement Systems 4pages, (date prior to Mar. 2, 2011).
Cummins: Jetsort Model CA 750 JetSort Coin Processor, 1page (date prior to Mar. 2, 2011).
Cummins: Jetsort Model 2000 Series JetSort High speed Coin Sorters, 2pages (date prior to Mar. 2, 2011).
Cummins: Jetsort Model 3000 Series High Speed Coin Counter 2 pages, (date prior to Mar. 2, 2011).
Cummins: JetSort® High Speed Sorter/Counter Kits I & J—Operating Instructions (Form 022-7123-00) 12 pages.
De La Rue: CDS 500 Cash Deponier System, 6 pages (date prior to Mar. 2, 2011) (German).
De La Rue: CDS 5700 and CDS 5800 Cash Deponier System, 7 pages (date prior to Mar. 2, 2011) (German) and translation.
Diebold: Merchant MicroBranch, "Merchant MicroBranch Combines ATM After-Hour Depository Rolled-Coin Dispenser," Bank Technology News, 1 page (Nov. 1997).
Fa. GBS-Geldbearbeitungssysteme: GBS9401SB Technical Specification, 24 pages (date prior to Mar. 2, 2011).
Frisco Bay: Commercial Kiosk, 4 pages (date prior to Mar. 2, 2011).
Glory: AMT Automated Merchant Teller, 4 pages (date prior to Mar. 2, 2011).
Glory: CRS-8000 Cash Redemption System, 2 pages (1996).
Hamilton: Hamilton's Express Banking Center, In Less Space Than a Branch Manager's Desk, 4 pages (date prior to Mar. 2, 2011).
ISH Electronic: ISH I2005/500 Coin Counter (with translation), 4 pages (date prior to Mar. 2, 2011).
ISH Electronic: ISH I2005/501 Self-Service Unit (with translation), 4 pages (date prior to Mar. 2, 2011).
Namsys, Inc.: Namsys Express, Making currency management . . . more profitable, 2 pages (date prior to Mar. 2, 2011).
NGZ Geldzahlmaschinengesellschaft: NGZ 2100 Automated Coin Depository, 4 pages (date prior to Mar. 2, 2011).
Perconta: Contomat Coin Settlement Machine for Customer Self Service, 2 pages (date prior to Mar. 2, 2011).
Prema GmbH: Prema 405 (RE) Self Service Coin Deposit Facility, 2 pages (date prior to Mar. 2, 2011).
Reis Eurosystems: CRS 6501/Crs 6510 Cash Receipt Systems, 4 pages (date prior to Mar. 2, 2011).
Reis Eurosystems: CRS 6520/ CRS 6525 Standard-Class Coin Deposit Systems, 1 page (date prior to Mar. 2, 2011).
Reis Eurosystems: CS 3510 Disc-Sorter, 1 page (date prior to Mar. 2, 2011).
Royal Bank: Hemeon, Jade, "Royal's Burlington drive-in bank provides customers 24-hour tellers," The Toronto Star, 1 page (Aug. 21, 1991).
Royal Bank: Leitch, Carolyn, "High-Tech Bank Counts Coins," The Globe and Mail, 2 pages (Sep. 19, 1991).
Royal Bank: Oxby, Murray, "Royal Bank Opens 'Super Branch,'" The Gazette Montreal, 2 pages (Sep. 14, 1991).
Royal Bank: SuperBranch, 2 pages (Feb. 1992).
Scan Coin: CDS 600 & CDS 640 Cash Deposit System—Technical Manual, 45 pages (date prior to Mar. 2, 2011).
Scan Coin: CDS 600 User's Manual, 14 pages (date prior to Mar. 2, 2011).
Scan Coin: CDS Cash Deposit System, 6 pages (date prior to Mar. 2, 2011).
Scan Coin: CDS Coin Deposit System—Technical Referens Manual, 47 pages (1989).
Scan Coin: CDS MK 1 Coin Deposit System—Technical Manual, 32 pages (1991).
Scan Coin: International Report, 49 pages (Apr. 1987).
Scan Coin: Money Processing Systems, 8 pages (date prior to Mar. 2, 2011).
Scan Coin: SC 102 Value Counter Technical Manual, 28 pages (date prior to Mar. 2, 2011).
Scan Coin: World, 2 pages (Feb. 1988).

* cited by examiner

APPARATUS, SYSTEM AND METHOD FOR COIN EXCHANGE

CROSS-REFERENCE

This application claims the benefit of priority from U.S. Provisional Patent Application Serial No. 61/038,730 filed on Mar. 21, 2008, entitled "Apparatus, System and Method For Coin Redemption". This application further claims priority to, and is a continuation in part of, co-pending U.S. patent application Ser. No. 11/726,828 filed on Mar. 23, 2007, entitled "Systems, Apparatus, and Methods For Currency Processing Control and Redemption". This application further claims the benefit of priority from, and is a continuation in part of, U.S. patent application Ser. No. 11/803,281, filed on May 14, 2007 now U.S. Pat. 7,949,582, entitled "Automatic Document Processing System Using Full Image Scanning," which is a continuation of U.S. patent application Ser. No. 10/084,856, filed on Feb. 27, 2002, entitled "Automatic Funds Processing System," which is a divisional of U.S. patent application Ser. No. 08/814,978, filed on Mar. 11, 1997, entitled "Automatic Document Processing System Using Full Image Scanning" (now U.S. Pat. No. 6,363,164); which is a continuation in part of U.S. patent application Ser. No. 08/664,262, filed on May 13, 1996, entitled "Automatic Funds Processing System" (now U.S. Pat. No. 5,982,918), and claims the benefit of priority of U.S. patent application No. 60/031,604, filed on Nov. 27, 1996, entitled "Automatic Funds Processing System" (expired). This application further claims the benefit of priority to, and is a continuation in part of U.S. patent application Ser. No. 11/945,671, filed on Nov. 27, 2007 now abandoned, entitled "Image Processing Network," which is a divisional of U.S. patent application Ser. No. 10/393,867 (now U.S. Pat. No. 7,349,566) filed on Mar. 20, 2003, entitled "Image Processing Network," which is a divisional of U.S. patent application Ser. No. 09/059,813, filed Apr. 14, 1998 now U.S. Pat. No. 6,661,910, entitled "Network for Transporting and Processing Images in Real Time," which claims the benefit of U.S. Provisional Patent Application Serial No. 60/043,516, filed Apr. 14, 1997, and United States Provisional Application No. 60/053,606, filed Jul. 22, 1997, all of the above applications of which are incorporated herein by reference in their entirety, with the exception of U.S. patent application Ser. No. 11/945,671 and U.S. Provisional Patent Application Serial No. 61/038,730 which are not incorporated herein by reference, and the benefit of priority is claimed to all of the above applications.

FIELD OF ENDEAVOR

The present invention relates generally to the field of bulk coin handling systems and, more particularly, to exemplary apparatuses, systems, and methods for bulk coin exchange.

BACKGROUND

Currency processing machines generally have the ability to receive bulk currency (e.g., currency bills and/or coins) from a user of the machine. Coin processing modules, for example, are commonly used as coin redemption machines wherein, after the deposited coins are counted and totaled, a receipt is issued indicating the value of the deposited coins. The user may exchange this receipt for the amount of deposited coins in the form of currency bills or, optionally, for an amount of the deposited coins less a commission charged for use of the coin redemption machine.

Coin redemption machines are used in banking environments (in patron accessible areas and in employee-only areas), business environments (e.g., armored transport services, telephone companies, etc.) and retail environments, such as grocery stores. In operation, a user inputs a batch of coins of mixed denominations into a hopper of the coin redemption machine. The machine discriminates items that are not valid coins, determines the value of the valid deposited coins and outputs a receipt indicative of the determined amount. In some embodiments, the receipt also indicates a second, lesser amount, which reflects a commission charged for use of the machine. The user exchanges the receipt for paper currency for the value of the deposited coins less the commission. In a banking environment, a user may exchange the receipt at a teller's window, whereas, in a retail environment, the user can exchange the receipt at a cashier's station or a patron-service station. In one example, the coin redemption machine disclosed by Molbak in U.S. Pat. No. 6,976,570, receives a number of unsorted coins, sorts the coins, counts the total value of the valid coins, and outputs a voucher related to the total amount (i.e., less a commission charge for the use of the machine). The user then takes this voucher to a cashier or clerk for redemption, following the verification of the authenticity of the voucher by the cashier or clerk.

One disadvantage associated with conventional coin redemption machines is the potential for fraud which exists with current receipt-type systems or voucher-based systems. For example, a receipt or voucher can be duplicated (i.e., counterfeited) and then exchanged more than once resulting in a loss for that particular store. Additionally, receipts or vouchers may be altered, so as to fraudulently increase an apparent value of the receipt in an attempt to obtain more money from the receipt that its true value. Accordingly, as one example, U.S. Pat. No. 6,349,972 to Geiger et al. discloses a coin redemption machine printed voucher comprising various devices to deter, reduce, or eliminate unauthorized duplication or counterfeiting of such voucher, including special inks, papers, indicia, and/or perforations. These security devices, and many others (e.g., holograms, optically variable devices, watermarks, fluorescent fibers, taggants, threads, barcodes, batch and date codes, micro-perforations, etc.), have been long-known in the negotiable instrument field and have been applied to negotiable instruments in a long-standing struggle to stem losses attributable to counterfeiting and stay ahead of counterfeiters.

Additional disadvantages associated with the conventional coin redemption machines include, but are not limited to, additional time and steps associated with the redemption process, inconvenience to the bearer of the receipt or the voucher, unfamiliarity with the receipt or voucher security features by the clerk or cashier, and human error.

SUMMARY OF THE DISCLOSURE

The aspects of the present concepts disclosed herein are generally directed to coin exchange machines configured to provide security measures to guard against the unauthorized access and/or use, and to protect against counterfeiting or forging of vouchers or negotiable instruments issued therefrom.

In accord with one aspect of the present concepts, there is provided a method for exchanging coins in a retail environment, the method comprising the acts of receiving a plurality of coins in a coin processing machine disposed in a retail environment, the coin processing machine comprising a currency dispenser, processing the plurality of coins to determine a total value of the plurality of coins, and dispensing currency to the patron from the currency dispenser, the currency having a value related to the total value.

In accord with another aspect of the present concepts, self-service coin exchange apparatus for exchanging currency for coins in a public area is disposed in a public area and comprises a coin input region configured to receive from a patron of a retail establishment a plurality of coins of arbitrary denomination, a coin processing device configured to determine a total value of the input coins and to discharge the coins to one or more coin receptacles, and a currency dispenser configured to dispense currency for a value related to the total value.

The above summary of the present invention is not intended to represent each embodiment, or every aspect, of the present invention. Additional features and benefits of the present invention will become apparent from the detailed description, figures, and claims set forth below.

BRIEF DESCRIPTION OF THE DRAWINGS

Other objects and advantages of the invention will become apparent upon reading the following detailed description in conjunction with the drawings.

Figure 1:
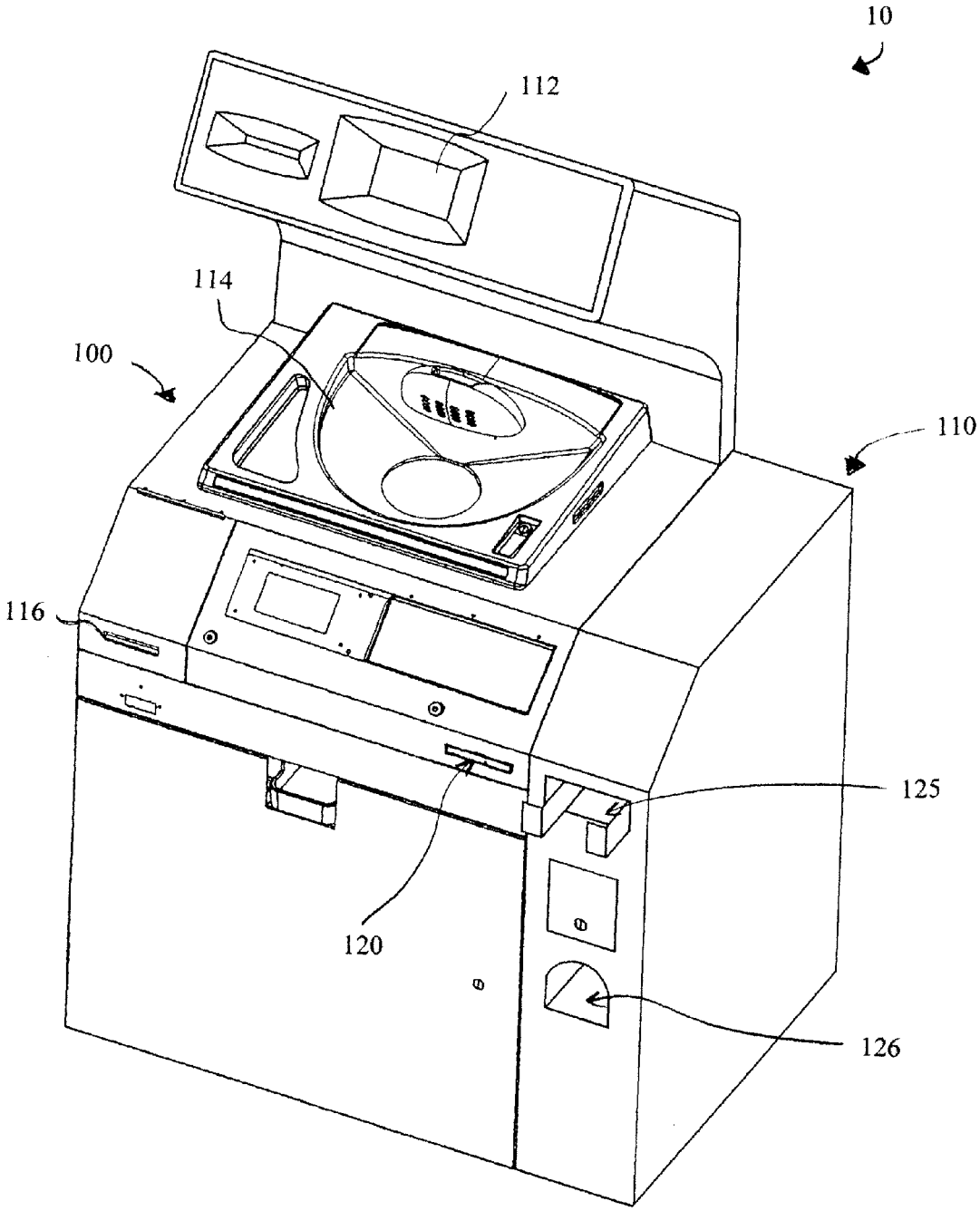
FIG. 1 is a perspective view of a coin exchange machine in accord with at least some aspects of the present concepts.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

FIG. 1 shows one example of a coin exchange machine 10 in accord with at least one example of an aspect of the present concepts, the self-service coin exchange machine 10 comprising a coin processing module 100 and a currency dispensing module 110.

In the embodiment of the self-service coin exchange machine 10 shown in FIG. 1, the self-service coin exchange machine 10 includes a touch screen 12 and/or other user interface(s) to receive inputs from a user and to display information and prompts or queries to the user. While the touch screen 12 is a presently preferred mode to enter data from the user of the self-service coin exchange machine 10, the self-service coin exchange machine may additionally comprise a keypad, a keyboard, a microphone, and/or one or more buttons to receive user inputs. The user may be permitted to make inputs at any time to select various options before or after processing of the currency. For example, following processing of a batch of coins, the user may be prompted to confirm that the transaction is complete or to confirm that additional coins are to be included with the previously input batch. A card reader is also advantageously, but optionally, provided to enable the self-service coin exchange machine 10 to read data borne by a magnetic strip of a patron's credit card, bank card, ATM card, debit card, or retail card (such as Target, or Jewel, etc.), and/or to read data borne by a card based data storage medium (e.g., optical card, smart card, etc.).

As noted above, the self-service coin exchange machine 10 includes a coin processing module 100, which comprises a coin input area 114 configured to receive a batch of coins of a single denomination or mixed denominations from a user for processing such as sorting, discriminating, and/or counting. Once processed, the value of the batch of coins may be determined and the value converted to another medium, as described herein.

The coin processing module 100 may comprise, for example, those disclosed in U.S. Pat. Nos. 7,188,720 B2, 6,996,263 B2, 6,896,118 B2, 6,892,871 B2, 6,810,137 B2, 6,755,730 B2, 6,748,101 B1, 6,731,786 B2, 6,724,926 B2, 6,678,401 B2, 6,637,576 B1, 6,603,872 B2, 6,579,165 B2, 6,318,537 B1, 6,171,182 B1, 6,068,194, 6,039,645, 6,021,883, 5,997,395, 5,982,918, 5,943,655, 5,905,810, 5,743,373, 5,630,494, 5,564,974, and 5,542,880, each of which is assigned to the present assignee and each of which is incorporated herein by reference in its entirety. Alternatively, the coin processing module 110 may comprise a gravity rail sorter, such as that disclosed by Molbak in U.S. Pat. No. 6,976,570, which is incorporated herein by reference in its entirety, powered rail sorter, a multi-disc or disc-to-disc sorter, or other type of bulk coin processing mechanism or system. In accord with aspects of the present concepts such as that represented in FIG. 1, the coin processing module 100 is functionally associated with a currency dispensing module 110 and outputs thereto a signal relating to the total amount of the deposited valid coins. In general, in the disc-type systems disclosed above, the batch of coins input by a user into the coin input area 114, which may comprise a coin tray or coin receptacle area (e.g., a funnel) or other area adapted to receive input coins, is conveyed to a hopper, which deposits the coins into a central region of a rotating, resilient pad. As a disc bearing the resilient pad is rotated at a high speed by a stub shaft and electric motor (not shown), coins deposited on the resilient pad slide outwardly over the surface of the pad due to centrifugal force (i.e., they are subjected to sufficient centrifugal force to overcome their static friction with the upper surface of the resilient pad) and a stationary sorting head disposed adjacent and opposite to the resilient pad guides coins of specific denominations, via contours (e.g., walls, grooves, rails, etc.) formed therein, to designated exit stations, where they are each discharged through an exit slot specific to the denomination of the coin.

One or more coin sensors may be utilized, either within the stationary sorting head and/or outside of the stationary sorting head, to count and/or discriminate the coins. In other words, the coin processing module 100 optionally includes sensors configured to permit coin discrimination and the sorting out of any counterfeit coins, foreign coins, and/or non-desired denominations. Coin discrimination is disclosed, for example, in references including, but not limited to, U.S. Pat. Nos. 6,892,871, 6,755,730, 6,609,604, 6,171,182, 6,042,470, 5,865,673, and 4,543,969, each of which is hereby incorporated by reference in its entirety.

In the example of FIG. 1, the coin processing module 100 coin input area 114 is of a "gravity-feed" type that is generally funnel-shaped to direct coins to a coin processing area within the coin processing module. Alternatively, the coin input area

114 could utilize a pivoting coin tray such as, but not limited to, that shown in U.S. Pat. No. 4,964,495 or U.S. Pat. No. 6,976,570, which are each incorporated herein by reference in their entirety. Such pivoting coin trays permit movement of the tray from a first position, where the coin tray is substantially horizontal, to a second position, wherein the coin tray is inclined so as to cause the coins to slide downwardly under the force of gravity into the coin processing module 100. Alternatively, any other input device employing any alternative means of conveyance may be utilized in accord with the present concepts including, but not limited to a conveyance system (e.g., conveyor belt(s), a rotating disc, or a plurality of counter-rotating discs, etc.).

The self-service coin exchange machine 10 optionally includes a paper dispensing slot 16 and/or other dispensing slots or ports for providing a user with a receipt of a transaction performed at the self-service coin exchange machine. The self-service coin exchange machine 10 may give the user the option of receiving a printed receipt or may automatically provide a printed receipt. A receipt may advantageously be provided in accord with each of the aspects of the present concepts and embodiments described herein.

Further, one or more actuators or actuated devices may be utilized, either within the stationary sorting head and/or outside of the stationary sorting head, to control the movement of the coins within the coin processing module or outside of the coin processing module. For example, in some embodiments, coin counting sensors are disposed in each of the coin exit channels of the sorting head or are disposed just outside the periphery of the sorting head. As coins move past each counting sensor, the controller receives a signal from the counting sensor for the particular denomination of the passing coin and adds one to the counter for that particular denomination within the controller. The controller, in turn, maintains a counter for each coin denomination, monitors the output of coin discrimination sensor(s), and compares information received from the discrimination sensor to master information stored in a memory including information obtained from known genuine coins. If the received information does not favorably compare to master information stored in the memory, the controller sends a signal to the actuator(s) causing the segregation of the invalid coins from the valid coins.

Coins discharged from the coin processing module 100 are discharged into one or more coin receptacles such as, but not limited to, a coin bin, coin bag, coin cassette, rolled coin tube packages, etcetera. The coin receptacle(s) are configured to either receive a single denomination of coin (e.g., quarters only) or to receive any combination of mixed denominations of coins (e.g., quarters and dimes in a mixed bag).

The self-service coin exchange machine 10 is configurable to direct a specific denomination or denominations to various coin bag positions on the sorting machine depending upon the needs of the purchaser or lessor. For example, a purchaser or lessor in the vending field might only process nickels, dimes, and quarters. In this case, to fully utilize the bagging capacity of the machines, the purchaser or lessor could select nickels to be sent to coin bags #1 and #2, dimes to coin bag #3, and quarters to coin bags #4, #5, and #6. For an application in which a large volume of pennies could be expected, the purchaser or lessor could select pennies to be sent to coin bags #1, #2, #3 and #4 with all other coins being directed to coin bags #5 and #6. For a self-service application, since pennies and quarters make up roughly about 80% of the total volume of coins processed, one suitable machine configuration would direct pennies to coin bags #1, #2, #3 and #4 and quarters to bags #5 and #6, with other denominations (dimes and nickels) being directed to the remaining bag positions (e.g., coin bags #7 and #8) either mixed or unmixed. One problem with current fixed bag position sorting machines is that, once a bag (or bags) for a particular denomination is full, the machine stops, requiring the attendant to change out at least that coin bag. This could happen during a patron transaction, requiring immediate attention by an attendant. In accord with at least some aspects of the present concepts, the self-service coin exchange machine 10 comprises a programmable sorter configured to permit one bag position to be selected as an "overflow" that would accept coins from denominations that have reached their bag limit at their sorted bag position. With this configuration, coins of selected denominations would be directed to the "overflow" once their bag limit has been reached. The overflow bag would contain mixed denomination coins that would need to be sorted during a post sorting operation. This configuration would maximize the time between bag changes, allow patron transactions to finish without the need to stop the machine for a bag change, and minimize to the extent possible the need for post sorting operations. It is to be noted that a given self-service coin exchange machine 10 may include more or less coin bags than noted in the above examples, which are merely illustrative.

The self-service coin exchange machine 10 may also be programmed to maintain a history of transactions wherein the mix of coins and amounts of coins deposited in the machine is trended to, for example, permit estimation of the average, and $1\sigma$, $2\sigma$, and $3\sigma$ values of standard deviation for coin deposits, such that the self-service coin exchange machine 10 may estimate before a transaction is conducted whether or not the coin bags (or coin bin or other receptacle(s)) have sufficient capacity to accept another transaction. For example, to ensure that a patrons transaction will not be interrupted, a purchaser or lessor of the self-service coin exchange machine 10 may opt to instruct the self-service coin exchange machine to perform a requested transaction only if the coin bags have sufficient capacity to accept two, three, four, or five $3\sigma$ coin deposits (e.g., providing multiples of large historic coin transactions). So configured, the self-service coin exchange machine 10 would advantageously take itself out of service if the coin bags or other receptacles do not have sufficient capacity to safely accept coin deposits exceeding a predetermined threshold, preferably prominently displaying the out of service condition on the machine display and transmitting a signal (e.g., email, fax, text message, etc.) a recipient computer or electronic device designated by the purchaser, lessor, POS terminal, manufacturer, or designated third party informing such recipient of the self-service coin exchange machine 10 condition. Obviously, the predetermined threshold may be set lower (i.e., at any level desired) so as to provide greater forewarning and permit more flexibility in response prior to the self-service coin exchange machine 10 being placed in an operability compromised state.

The coin receptacles preferably, but not necessarily, include an RFID tag that may be passive, active, or semi-passive, or other tracking device (e.g., electronic tracking device, GPS transmitter, bar code, etc.), singly or in combination, to enable tracking of these receptacles by armored carriers, stores or banks. Larger receptacles, such as bins, may advantageously include a GPS transmitter to independently transmit location information to a tracking databases and, optionally, a security monitoring service. The self service coin exchange machine 10 may advantageously be configured to write transaction related information, particularly a total value of processed coins input into the receptacle since insertion of the empty receptacle into the self-service coin exchange machine, directly to the integrated circuit of such an RFID. Thus, when an armored carrier arrives at the self-service coin exchange machine 10, the armored carrier would scan the RFID tag, bar code, or other identifying information or device for each receptacle using an appropriately configured scanning device and this information would be transmitted by the scanning device or an associated transmission device to one or more remote databases (e.g., a tracking system, an accounting system, etc.). Where the receptacle includes an RFID upon which the receptacle value information was written by a coin exchange machine 10 transmitter, using appropriate security protocols, the armored carrier central vault would be able to not only identify and track a physical location of the receptacle, but would also be able to automatically determine the value of coins in the receptacle. In the carrier central vault, employees can then balance specifically to each identified receptacle to ensure that each receptacle includes the correct amount. Later, when the receptacles are to be returned empty to the same self service coin exchange machine 10, or to another self service coin exchange machine, the receptacle is checked-in, such as by an RFID scan, or the like, as a bin leaves the central vault and/or possession of the armored carrier (i.e., insertion of the receptacle back into the machine at a self service coin exchange machine 10). In other aspects, value information may be coded onto a ticket dispensed by the self-service coin exchange machine 10 into the receptacle when the receptacle is full or upon an input command from an authorized user (e.g., an armored carrier employee).

In a presently preferred embodiment, the currency dispensing module 110 comprises a multi-cassette dispenser configured to dispense a plurality of denominations including $1 bills, $5 bills, $10 bills, and $20 bills, although a single-denomination dispenser, a single-cassette or a multi-cassette, could still be utilized in accord with the present concepts. Thus, the currency dispensing module 110 could comprise a single-cassette dispenser configured to dispense only $1 bills or only $5 bills, a multi-cassette dispenser configured to dispense $1 bills, $5 bills, and $10 bills, or any other type of configuration adapted to dispense one or more denominations of bills, in any combination, to a currency dispensing receptacle 125 for retrieval by the patron. The currency dispensing module 110 may comprise any OEM currency dispenser. Of course, although the examples herein relate to examples utilizing United States currency, the same concepts apply to currency of any country. For example, the currency dispensing module 110 may comprise one or more Fujitsu F53, F56, F400, or F510e multi-cassette media dispensers 127, or combinations thereof The Fujitsu F53 and F56, for example, feature six cassettes 127 that can hold up to a total of 3,000 bills (500 bills/cassette) in a compact configuration. Using these or other currency dispensing modules 110, multiple cassettes 127 may be devoted to the bill cassettes that are most heavily utilized, so that the utilization factor for each cassette is generally equalized over time to minimize machine down time or unavailability. For example, in a six cassette 127 currency dispensing module 110, two cassettes could be loaded to dispense $1 bills, two cassettes loaded to dispense $5 bills, one cassette loaded to dispense $10 bills, and one cassette loaded to dispense $20 bills. In another example, a six cassette 127 currency dispensing module 110 could comprise three cassettes loaded to dispense $1 bills, one cassette loaded to dispense $5 bills, and two cassettes loaded to dispense $20 bills. Any number of currency dispensing modules 110 and/or cassettes 127 therein may be provided and the example of a single currency dispensing module comprising six currency cassettes 127 is by no means limiting (e.g., one, two, three, four cassettes or more, such as twelve cassettes, may be provided or multiple currency dispensing modules may be ganged together in association with a single coin processing module 100).

Thus, the self-service coin exchange machine may be adapted, via the selection of appropriate modules, to suit its intended purpose, application, or environment and historic or expected usage. Likewise, any currency or combination of currencies may be dispensed. Thus, for example, the currency dispensing module 110 may have, in one embodiment, only one single denomination currency dispenser having only $1 bills. In another example, a single self-service coin exchange machine 10 may comprise a first currency dispensing module 110*a* configured to dispense currency of a first currency type (e.g., U.S. Currency) and a second currency dispensing module 110*b* configured to dispense currency of a second currency type (e.g., Euro). In still another example, a single self-service coin exchange machine 10 may comprise a currency dispensing module 110 comprising a first set of cassettes 127 configured to dispense currency of a first currency type (e.g., U.S. Currency) and a second set of cassettes 127 configured to dispense currency of a second currency type (e.g., Euro). Likewise, a single self-service coin exchange machine 10 may comprise two currency dispensing modules 110*a*-100*b*, with a first currency dispensing module 110*a* comprising currency cassettes 127 or the like configured to dispense currency of a first currency type (e.g., U.S. Currency), a second currency dispensing module 110*b* comprising currency cassettes 127 or the like configured to dispense currency of a second currency type (e.g., Euro).

Coin redemption machines typically count coins and deposit them into a bulk coin containers or bags, or mechanically sort and count coins and deposit each coin into a designated container or bag for each denomination. Machines of these configuration types are typically country specific, configured for the country's coin set either mechanically or electronically. These machines are limited to accepting only coins for the particular country for which they are configured. To avoid a situation in which a patron using a coin redemption machine residing on the border between two countries, such as the Canadian/US border, would attempt to deposit both USA and Canadian coins in the machine, resulting in a high number of rejected coins of either USA or Canadian (depending upon the configuration of the machine), the coin processing module 100 in accord with at least some aspects of the present concepts is configured to accept coins from two (or more) countries simultaneously by incorporating multiple off sort exits for the stationary sorting head noted above. Specifically, one or more universal exit slots can be provided to accept any size coin and voice coils, reject pins, diverters, or the like are provided downstream of the universal exit slot to divert the discharged coin to an appropriate coin receptacle (e.g., a bin or bag adapted to received mixed currency of a single currency type, such as U.S. Currency). For example, A U.S. configured self-service coin exchange machine 10 is configured to count, off sort, and bag pennies in exit #1, nickels in exit #2, dimes in exit #3, Quarters in exit #4, Half Dollars in exit #5, and Dollars in exit #6. If this self-service coin exchange machine 10 was located in upstate New York on the Canadian border, the $7^{th}$ exit could be configured to count and off sort and receive all 6 Canadian denominations in the same bag. The patron would receive a transaction record reflecting the total value of the coins counted for both the U.S. coins and the Canadian coins. As another example, a self-service coin exchange machine 10 is configured to count and sort the 8 Euro denominations out 8 universal exits and into 8 corresponding bags using mechanical sorting such as, but not limited to, voice coin, pin, or other diverter(s), and to count and sort 8 UK denominations but to off-sort the 8 UK denominations to a single exit into a mixed denomination bag or container. The patron would receive a transaction record reflecting the total coin counted for both the Euro coins and the UK coins.

Machines with this functionality could advantageously be deployed in International Airports, hotels, rail stations, or currency exchanges, to permit patrons to exchange coins of one currency type, or even plural currency types, for cash in a desired currency type (e.g., Euro coins and UK coins exchanged for Euro notes, Euro coins exchanged for U.S. Dollars, etc.) since direct exchanges of coins to currency in these venues typically do not exist. For example, one or more self-service coin exchange machines 10, each comprising one or more currency dispensers 110, is/are disposed in the Frankfurt airport in Germany to pay out a specific country's currency in exchange for the coins deposited (from one or more different currency types). Thus, as a convenience to it's patrons as well as a potential profit center, the airport could provide the capability to patrons to quickly convert a value of a patron's coins from one currency (e.g., Euro) to notes/bills, coins, and/or other media as described herein in another currency (e.g., U.S. Currency) based on the prevailing exchange rate, minus any optional commission or transaction fee. Optionally, a self-service coin exchange machine 10 is disposed next to the exchange window of a currency exchange and is configured to accept and sort coins a local currency type (e.g., Euro) and optionally one or more additional currency type(s), with such one or more additional currency type(s) (e.g., UK coins and Turkish coins) being sorted out to respective mixed coin containers in the self-service coin exchange machine. A patron would deposit any combination of the coins accepted by the machine (e.g., Euro, UK, Turkish) and receive a transaction record indicating the value of each country's coin total counted. The patron would turn in or display the transaction record for the currency exchange to pay out the value in any country's currency selected by the patron. Still further, the self-service coin exchange machine 10 may be disposed in the currency exchange booth or office for use by employees, rather than patrons. The employee would deposit the patrons coins and receive the transaction record. The employee would then pay out the to value to the patron, minus any optional processing fees, in any country's currency selected by the patron.

Since the self-service coin exchange machine 10 can be user configured to accept, count, sort, and bag any country's coin set into any bag position on the machine, the coin redemption sorter design can be "universal". For example, a machine can be constructed with 16 bag positions and 10 universal exit slots. Four of the ten exits are equipped with dual bags to increase the capacity of the self-service coin exchange machine for a particular denomination or mixed coin configuration. A patron could sort the six standard U.S. coins in this self-service coin exchange machine, sending pennies in the first three positions, into 6 sorted bags, quarters to the next three exits into another 6 sorted bags, nickels to the $7^{th}$ exit into 2 sorted bags, dimes to the $8^{th}$ position into 2 sorted bags, half dollars and dollars to the $9^{th}$ position into 1 mixed bag, and the complete Canadian coin set to the $10^{th}$ position into one mixed bag. Virtually any combination of denomination and exit configuration, or country's coin set and exit configuration, can be owner/lessor-programmed or pre-programmed by the manufacturer. Accordingly, one self-service coin exchange machine model can service the needs of multiple countries or varying configurations or sorting and bagging, thus reducing manufacturing and inventory costs.

As noted above, a self-service coin exchange machine 10 in accord with at least some aspects of the present concepts could include a bill dispensing module to dispense currency bills, from one or more currency bill storage units (e.g., currency cassettes 127), in an amount relating to a total value of the deposited coins, or in the amount of the deposited coins less a fee. For example, a deposit of $67.53 in coins into such self-service coin exchange machine 10 results in currency bills dispensed to the patron in an amount corresponding to the total amount of coins minus a transaction fee that would round the exchange amount to the next nearest integer value in accord with predetermined rules, such as rounding up or down and/or ensuring that the exchange amount falls within a certain range of acceptable values based on the total amount of coins counted (e.g., net $62.00, $63.00, $64.00, $65.00, $66.00, or $67.00 in bills to the patron). Thus, a base percentage, such as 5% could be applied to the total amount of the deposited coins as a base fee (yielding $64.15) and the remainder of $0.15 truncated to result in $64.00 dispensed to the patron for a 5.2% transaction fee.

However, as described below, it is presently preferred, but by no means necessary, to associate with the self-service coin exchange machine 10 a loose coin or rolled coin dispensing module 111 adapted to provide exact change to a patron. In accord with at least some aspects of the present concepts, the currency dispensing module 110 includes one or more coin dispensing module(s) 111 configured to dispense rolled coins and/or loose coins. For example, the coin dispensing module 111 may comprises at least one Suzo Cube Hopper MK2® or Suzo Evolution Hopper, which are single denomination hoppers configured to discharge a single denomination. Thus, the coin dispensing module 111 may advantageously comprise a Suzo Cube Hopper MK2® for each denomination to be dispensed therefrom (e.g., one for pennies, one for dimes, one for nickels, one for quarters). In still other aspects, the coin dispensing module 111 comprises a rolled coin dispenser, such as that manufactured by Omron Transaction Systems, Inc., configured to dispense rolled coins ($10 roll of quarters, $5 half-roll of quarters, $5 roll of dimes, $2.50 half-roll of dimes, etc.).

To prevent misuse or confusion, the self-service coin exchange machine 10 is optionally configured to selectively enable the coin processing module 100 for operation only following appropriate inputs by a patron through the user interface. Following the enabling of the coin processing module 100, the patron is only then permitted to input coins into the coin processing module for processing. This control may be effected, for example, by selectively locking and unlocking, using an electromagnetic lock or latch, a hood 105 disposed to occlude the coin processing module 100 coin input region. In the example depicted in FIG. 1, the hood 105 may, accordingly, optionally be prevented from rotating upwardly until such time as a patron initiates a transaction at the self-service coin exchange machine 10 and indicates a desire to use the coin processing module 100.

Particularly where the currency dispensing module 110 is not configured to or is not able to dispense cash in smaller denominations (e.g., $1 or $5 bills) and is not configured to or is not able to dispense loose or rolled coins, the currency dispensing module is advantageously configured to provide a user with an option of receiving a portion of the total amount of the valid coins that is less than the smallest denomination dispensed by the currency dispensing module, herein designated as the remainder, in a form other than cash (or coin). Thus, for a patron input of $58.43 in coins into a self-service coin exchange machine 10 comprising a typical ATM as a currency dispensing module 110, such currency dispensing module only being configured to dispense $10 or $20 bills, the currency dispensing module may only output $50 in cash to the patron (e.g., 2-$20 bills and 1-$10 bill), leaving a remainder of $8.43.

To account for any remainder, large or small, the currency dispensing module 110 is advantageously, but not necessarily, configured to provide a patron with one or more options for exchange of the remainder. Options for exchange may be presented to the patron before the transaction or after the transaction. For example, even though the self-service coin exchange machine 10 may be configured to output the exact value of the processed coins back to the patron in bills and coins, via a bill dispensing module and coin dispending module of the currency dispensing module, a patron may desire to receive a portion of the exchange amount in another media, in another form, or at another location. Such options for exchange may naturally also apply to more than just the remainder and may be available to the entire value of the processed coins.

For example, where the self-service coin exchange machine 10 is connected to a network (e.g., an ATM network/ATM system backbone, a bank teller network, a store network, a point of sale (POS) network, a third party accounting system, etc.), as opposed to being provided in a stand-alone configuration, the self-service coin exchange machine 10 is adapted to permit the patron to deposit the remainder into a designated account (e.g., a bank account, a store account, etc.), such as by requesting that the patron input a code or insert a bank card, magnetic stripe card (e.g., stored-value card), or other account-information bearing media (e.g., smart card, biometric input, near field transmission from a portable electronic device, etc.). Once the required identification and routing information has been obtained by the self-service coin exchange machine 10, the self-service coin exchange machine prompts the user to designate which portion of the monies due the patron are to be transferred to the designated account(s) or, alternatively, to a card or a device specified by the patron. For example, the device could be networked and connected to a store's or bank's accounting system and the patron permitted to apply the remainder or the entire amount of the transaction, if desired, to the patron's account at the store or bank. As one example, a patron processes $100 in mixed coins at a networked self-service coin exchange machine 10 in a bank and selects, from a plurality of available options, for $50 cash back in currency and for deposit of the remainder of $50 (assuming no transaction imposed fees) in the patron's bank account. In another example, a patron processes $100 in mixed coins at a networked self-service coin exchange machine 10 at a store and selects, from a plurality of available options, for $50 cash back in currency and for deposit of the remainder of $50 (assuming no transaction imposed fees) in a pre-approved patron account at the store for a later use.

Owing to the networked arrangement, the self-service coin exchange machine 10 may, whatever the location, provide alterative forms of splitting the dispensed value between a variety of forms, in any combination, including, but not limited to, currency, loose coin, rolled coin, a coupon, a ticket, a voucher, a stored value card, a prepaid card, a smart card, an optical card, other value storing mediums, an electronic transfer to a patron account, an electronic transfer to a third party account (e.g., a creditor of the patron), an electronic transfer to a portable electronic device. For example, one option for transfer of all of or a potion of the total value due a patron (e.g., a remainder following disbursement to the patron of a portion of the total value in currency) includes electronic transmission (e.g., near field communication) of such desired amount to a patron's portable electronic storage device (e.g., a cellular phone, electronic purse, electronic wallet, electronic cash, fob, etc).

In at least some aspects, a stored value media dispensing module 120 is configured to dispense to the patron a stored value media such as, but not limited to, a magnetic stripe card (e.g., a value card, a pre-paid card, a store card, etc.), magnetic strip ticket, or a smart card bearing on the card's storage medium a value associated therewith by the patron including an entire value of the processed coins or a portion of the value of the processed coins. In at least some aspects, networked self-service coin exchange machines 10 dispense a stored value media only after registering and activating the stored value media with an issuing entity or approved third party. The stored value media is optionally encoded to be exchangeable only in the retail environment in which the self-service coin exchange machine 10 is disposed or associated (e.g., a Home Depot specific card if the self-service coin exchange machine is disposed in a Home Depot or is otherwise associated with Home Depot, a Jewel stored value card if the self-service coin exchange machine is disposed in a Jewel or is otherwise associated with Jewel, etc.).

In at least some configurations, the patron is advantageously permitted to select a stored value media from one of a plurality of different available types or associations of stored value media. To facilitate the use of a single, generic stored value media to which may be applied any number of separate associations with one or more stores or accounts, the network, in at least some aspects, includes banks of account numbers set aside for assignment to a stored value media. For example, in some aspects, a "blank" stored value media contains a unique identification number and the database tracks the stored value media by such identification number. A patron desiring to associate the stored value media to be dispensed to Store X, or even plural stores (e.g., Store X and Store Y), having made such selections through the self-service coin exchange machine 10 user interface, would be issued a stored value media having a unique identification number associated in the network to the store(s) designated by the patron. Thus, the individual stored value media need not necessarily have pre-stored or pre-formatted thereon specific account information or specific store names and such information may be written to and/or printed on such stored value media, if at all, upon issuance. Of course, the issued stored value media may be comprise pre-stored or pre-formatted thereon to concretely associate the stored value media to a specific store or issuing source (e.g., bank) and all account information needed to permit activation of the account by transfer of the account information to the store, issuing authority, or third party managing card issuance for such store or issuing authority.

Similarly, as to the dispensing of gift certificates or vouchers to be used at a specific store or bank or affiliated retailer, in at least some aspects of the present concepts, the unique identification number of the gift certificate or voucher is pre-associated with a zero value until such time as the gift certificate or voucher is activated within the self-service coin exchange machine 10 network or activated within the network or database of the store, issuing authority, or third party managing gift certificate or voucher issuance for such store or issuing authority. Upon activation of a gift certificate or voucher in a verified transaction, the value designated by the patron is stored by the self-service coin exchange machine 10 network or the network or database of the store, issuing authority, or managing third party in association with the unique identification number of the gift certificate or voucher. Following issuance, the patron may then be provided with the registration information and the opportunity to associate personal identifying information thereto so that, should the gift certificate or voucher be lost, the patron may, upon verification of the identifying information previously associated with the unique identification number of the gift certificate or voucher, obtain a replacement gift certificate or voucher if the unique identification number of the gift certificate or voucher may be cancelled prior to exchange thereof.

In still other aspects of the present concepts, in lieu of a stored value media dispensing module 120 that may be integrated with the self-service coin exchange machine 10, a stored value media kiosk may be provided separately thereto. In some aspects of the present concepts, the stored value media kiosk would be separate from the self-service coin exchange machine 10, but may be adjacent to the self service coin exchange machine. In such aspects, the stored value media kiosk is disposed in a location in a store other than the location in which the self-service coin exchange machine 10 is disposed. The stored value media kiosk comprises, in essence, a vending device configured to dispense one or more stored value cards, preferably a plurality of different stored value cards. For example, in one configuration, the stored value media kiosk is configured to dispense about thirty different stored value cards by different merchants. In such aspects, the self service coin exchange machine 10 would be able to transmit to the stored value media kiosk via a hardwired or wireless connection transaction related data that uniquely associates the value of transaction to the patron, such as through a patron ID number, a patron claim number, a transaction number.

The stored value media kiosk, in some aspects, is a stand alone kiosk configured to dispense a plurality of stored value cards or other items having a stored value thereon or having a value associated therewith. In one aspect, for example, a stored value media kiosk comprises a card dispenser configured to dispense any one or more of 30-40 different stored value cards having a value directly stored thereon or having information encoded therein associated with an account that is associated with a value. As one example of the use of a coin exchange machine 10 in combination with a separate stored value media kiosk, a patron processes all their coins and, based on the determined total value of the processed coins, receives a credit of $100.00. The self-service coin exchange machine 10 then issues a claim ticket with a unique ID number to the patron. The patron may then use this claim ticket, such as by scanning the claim ticket at the stored value media kiosk or inserting the claim ticket into the stored value media kiosk, to purchase a stored value card therefrom. Alternately, the patron might receive a value to a specified account (e.g., ATM card account, credit card account, etc.) or store card (such as Target or Jewel) which could be used towards the purchase of a value card from the kiosk. In another alternative, the patron could use an ATM card, credit card, biometric input (e.g., fingerprint, vein scan, etc.), or other personal electronic device to create a unique ID associating the patron to the value of the transaction. The association of the patron to the value of the transaction (e.g., the credit of $100.00 in the above example), whether through a unique ID generated by the self-service coin exchange machine 10 or by a unique ID generated responsive to an input or inputs by the patron, could be electronically transmitted to a network or to the stored value media kiosk, or encoded into or printed onto the claim ticket. The patron could then walk over to the stored value media kiosk and select the card or cards they wish to purchase and insert the claim ticket and/or provide other input of the unique ID generated in association with the patron's transaction.

In the above-described embodiment, the stored value media kiosk dispenses cards having a value stored thereon or stored in association therewith. Alternatively, the stored value media kiosk could dispense cards having no value stored thereon and/or having no value stored in association therewith. The patron could, at any time, approach a stored value media kiosk and select one or more stored value cards to be dispensed. A patron could then go to a store POS terminal and present the desired value card(s) together with the claim ticket or other item uniquely associated with the coin exchange transaction, whether a store card, ATM card, biometric input, or the like, in order to purchase the value cards at that time. If the patron presents a claim ticket, for example, the employee at the point of sale terminal or at the service desk, as applicable, would manually enter the PIN number or scan the PIN number. An authorized match would then appear on a POS display relative to the claim ticket number (or other item uniquely associated with the coin exchange transaction), and would display the total amount of the coin exchange transaction. Value cards and/or other merchandise could then be purchased for up to the total amount of credit available against the claim ticket or other item uniquely associated with the coin exchange transaction. For example, the employee at the point of sale terminal or service desk could swipe or scan the patron's store card (e.g., a "Safeway" card) to thereby enter the patron's patron number and then the appropriate credit available from the coin exchange transaction will be displayed on an associated POS or service desk display to enable the patron to purchase the stored value card(s). Alternatively, the employee at the point of sale terminal or service desk could swipe or scan the patron's ATM card or other card to thereby retrieve from a memory the patron's credit available from the coin exchange transaction and to display this information on an associated POS or service desk display to thereby enable the patron to purchase the stored value card(s).

In accord with various aspects of the present concepts, the coin processing module 100, the currency dispensing module 110, the stored value media dispensing module 120, or the document processing module 130 controls the processes described herein (e.g., the remaining ones of the aforementioned modules being a "slave" module thereto). Thus, in accord with other aspects of the present concepts, the currency dispensing module 110 controls the processes described herein and the coin processing module 100, the stored value media dispensing module 120, and the document processing module 130 are effectively slave modules to the currency dispensing module. In still other aspects, signals from any of the coin processing module 100, the currency dispensing module 110, stored value media dispensing module 120, and/or the document processing module 130 are transmitted to an external local or remote processor, such as a secure local network or wide area network, for processing. Thus, the actual processing functions may be performed by any of the component parts of the self-service coin exchange machine 10 singly or in combination and/or may be performed elsewhere.

As one example of a configuration in accord with at least some aspects of the present concepts, the currency dispensing module 110 comprises an ATM. Thus, the self-service coin exchange machine 10 may comprise, in some aspects, a coin processing module 100 as a side car attachment to an existing ATM, which is used to perform as a currency dispensing module 110 and to provide the primary user interface for the transaction. In such configuration, the coin sorting module would become a slave of the ATM unit and the patron would use the ATM user interfaces (e.g., key pad, touch screen, keyboard, etc.) to conduct the coin processing transaction on the associated coin processing module 100.

Following completion of the coin processing of the coins using the coin processing module 100, the controller that controls the coin processing module, wherever resident, outputs a signal to the currency dispensing module 110 (e.g., an ATM in the present example) and/or other value output device, such as a stored value media dispensing module 120, relating to the total value of the processed coins to thereby cause the currency dispensing module to dispense at least a portion of an exchange amount in currency, such as bills or a combination of bills and loose coins or rolled coins. The output signal to the stored value media dispensing module 120, likewise, causes the association of a specified portion of the exchange amount to a designated stored value media, which is dispensed to a user or held by a user. For example, the dispensing of the stored value media comprises, in various aspects, the dispensing of a ticket, pre-paid card, or stored value card.

The association of the specified portion of the exchange amount likewise comprises associating the specified portion of the exchange amount to not only a stored value media issued by the self-service coin exchange machine 10, but alternatively to a stored value media inserted by the patron into the self-service coin exchange machine. The association of the specified portion of the exchange amount comprises, in some aspects, forming in a remote database an association between the stored value media and the specified portion of the exchange amount. The association of the specified portion of the exchange amount comprises, in other aspects, writing on the stored value media itself a value corresponding to specified portion of the exchange amount. In still other aspects, such association comprises transferring of the specified portion of the exchange amount to a local or personal electronic device (e.g., a cellular phone, electronic purse, electronic wallet, electronic cash, or the like) or a remote electronic device (e.g., a patron account). In one exemplary transaction in accord with at least one embodiment of the disclosed coin exchange machine 10, the patron introduces a mixed batch of coins into the coin processing module 100 and, seconds later, receives from the currency dispensing module 110 a corresponding amount of bills and loose change, optionally less a transaction fee. In other types of transactions, a patron may use the self-service coin exchange machine 10 user interface desire to input commands to split the value between cash dispensed by the currency dispensing module 110 and an electronic transfer to the patron's personal electronic device and/or to an account (e.g., bank account) designated by the patron.

Figure 2:
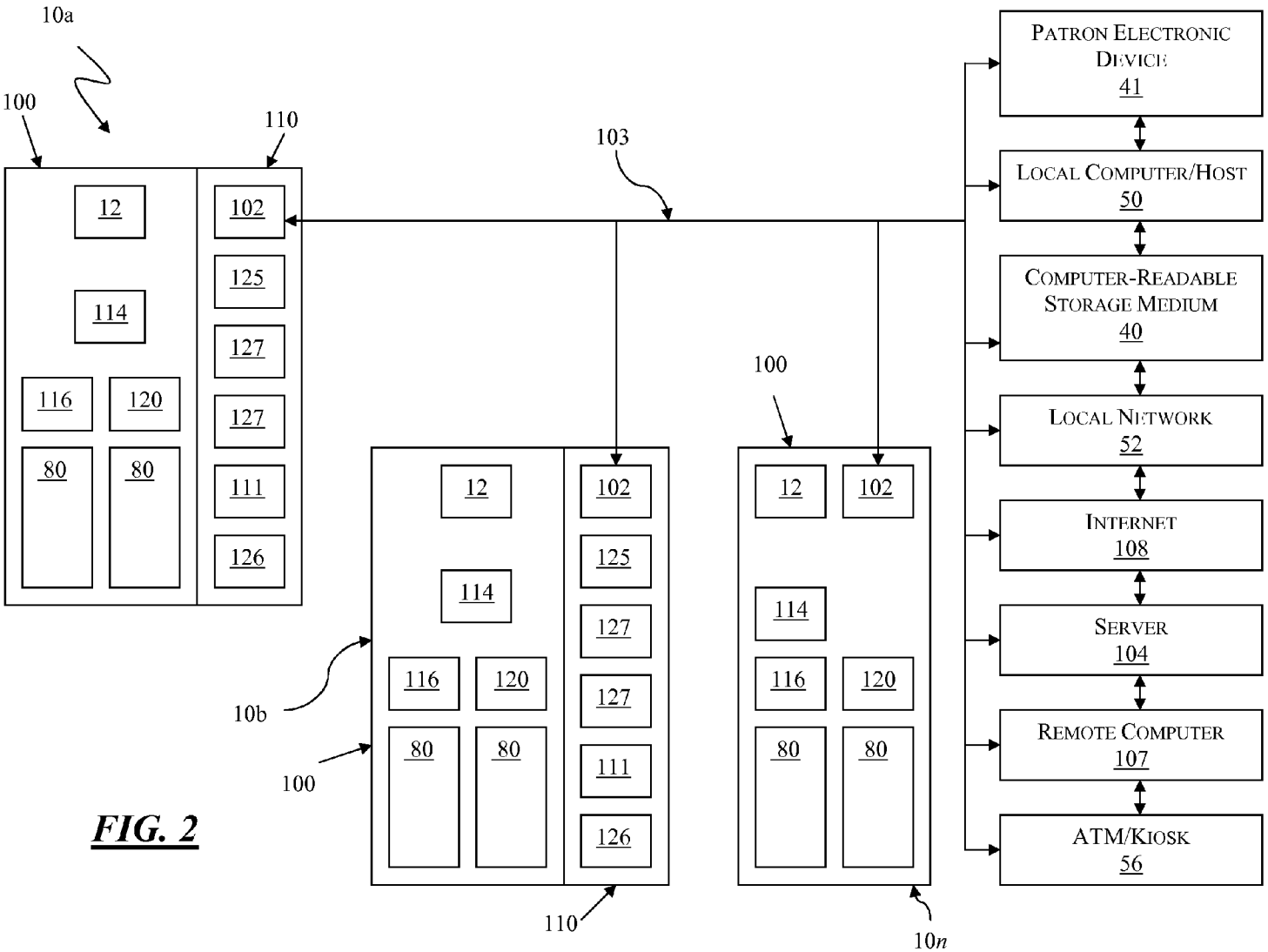
FIG. 2 schematically illustrates a plurality of self-service coin exchange machines in communication with a network or other local and remote devices in accord with at least some aspects of the present concepts.

FIG. 2, for example, shows a representation of a plurality of self-service coin exchange machines 10*a*, 10*b* . . . 10*n*, wherein n may be any number, communicatively coupled through a communication device 102 (e.g., a serial port, parallel port, USB port, ECP port, IEEE 1394 port, broadband device, Ethernet port, wireless device (e.g., Bluetooth, WLAN, IrDA, RF, IR, ZigBee, Wireless USB, and IEEE 802.11), modem, land line (POTS) cellular phone, and/or other communication device as appropriate to the type of communication needed) and associated communication pathway 103 to any one or more of a local computer/host system 50, a computer-readable storage medium 40 (e.g., a flash memory device, a hard drive, a solid-state memory device, a magnetic memory card, a magnetic disk, an optical disk, memory chip, memory card, USB flash drive, etc.), a patron electronic device (e.g., a PDA, a cellular phone, an electronic purse/wallet, smart card, etc.), a local network 52, the Internet 108, a server 104, a remote computer 107, and/or an ATM/kiosk 56. To facilitate different types of communication, the self-service coin exchange machines 10*a*, 10*b* . . . 10*n* advantageously include a plurality of different communication devices 102 such as any one or more of a serial port, parallel port, USB port, ECP port, IEEE 1394 port, broadband device, Ethernet port, wireless device, modem, land line (POTS) cellular phone, RF device, IR device, in any combination. As shown, the self-service coin exchange machine 10*n* does not include a currency dispensing module and instead comprises a stored value media dispensing module 120 and a communication device 102 configured to communicate via communication link 103 with any one or more of the nodes shown in FIG. 2.

Further, the plurality of self-service coin exchange machines 10*a*-10*n* may be linked directly to one or more other self-service coin exchange machines. As one example, a host system 50 communicates with each self-service coin exchange machine 10*a*-10*n* for tracking the various transactions occurring therein. Additionally, the self-service coin exchange machines 10*a*-10*n* are advantageously configured to send signals to the host system 50 to communicate system information, such as, but not limited to, signals indicating that one or more coin receptacles 80 of the coin processing module 100 are full or past a predetermined limit, one or more cassettes 127 or denominations of the currency dispensing module 110 are empty or past a predetermined limit, one or more coin dispensing modules 111 are empty or past a predetermined limit, a stock of stored value media in the stored value media dispensing module 120 falls below a predetermined threshold, a trended characteristic of a self-service coin exchange machine component or system has exceeded a threshold operating condition, or a fault condition (e.g., a coin jam, dispenser error, etc.) has occurred.

The self-service coin exchange machine 10 disclosed herein is particularly beneficial in retail applications and in banking or financial institution applications and provide needed self-service direct exchange capability providing the patron with the capability of directly receiving an exchange amount without any intermediary. In retail applications, unlike conventional voucher dispensing machines which require an employee to validate the exchange transaction and introducing the potential for fraud, the patron is immediately provided with cash or cash and coin exchange and/or with a plurality of exchange options including, but not limited to, cash or cash and coin. In view of at least some aspects of the present disclosure, additional optional exchange options may include disbursements including other media or electronic transfers. In a like manner, introduction of the presently disclosed self-service coin processing machine 10 into banking or financial institutions provides relief to bank tellers that would otherwise be required to, for conventional voucher dispensing machines, independently validate coin processing transactions by assessing the validity of a submitted voucher.

The self-service coin exchange machine 10 advantageously but optionally comprises, in at least some aspects, a document accepting module 130 configured to accept documents including, for example, currency bills, tickets, checks, or other security paper or bearer paper. In different aspects, the document accepting module 130 is configured to accept such documents either one at a time or in bulk. Exemplary references disclosing currency and document discrimination or authentication include, but are not limited to, U.S. Pat. No. 3,280,974 (magnetic flux), U.S. Pat. No. 3,870,629 (patterns of grid lines), U.S. Pat. No. 5,151,607 (security thread), U.S. Pat. No. 4,617,458 (magnetizable material), U.S. Pat. No. 4,593,184 (magnetic fields), U.S. Pat. No. 4,356,473 (denomination scans); U.S. Pat. No. 4,381,447 (density), U.S.

Pat. Nos. 4,490,846 or 4,992,860 (color), U.S. Pat. No. 4,255,651 (length and thickness), U.S. Pat. No. 4,179,685 (reflectance and transmission); U.S. Pat. No. 5,122,754 (watermark, security thread); U.S. Pat. No. 3,764,899 (thickness), U.S. Pat. No. 3,815,021 (dielectric properties), U.S. Pat. Nos. 5,704,491, 5,790,693, 5,960,103, 6,351,551, 6,724,927, 6,778,693, and 7,016,767, 7,149,336, 7,191,657, 7,197,173, 7,200,255, and 7,201,320, each of which is assigned to the present assignee and is hereby incorporated by reference in its entirety. Other features and characteristics of the currency media may also be used, without limitation, to perform a discrimination function appropriate to such media.

The document accepting module 130 may further be associated with an imaging module configured to image and/or scan the documents input into the document accepting module 130. When imaging bulk documents, the document accepting module 130 or other controller, wherever resident (local or remote), advantageously stores transaction information in association with each imaged document. The transaction information may comprise any transaction information including, but not limited to, machine, time, date, location, patron identifying information, total value of transaction, documents relating to transaction, etcetera. After or concurrent with imaging of the document(s), the images are preferably, but not necessarily, transmitted to a remote storage medium through a hardwired or wireless communication link, such as through a network connection. The imaged documents are optionally securely stored in the document accepting module 130 or related device, such as the currency dispensing module 110, coin processing module 110, or the like, wherever such memory devices are resident. In configurations wherein the self-service coin exchange machine 10 is disposed in a bank or a store, such bank or store could, for example, begin immediately processing the image (e.g., an imaged check) once the image was transferred to a designated software platform or person in the bank or store.

Document imaging also permits, for example, capture of the serial number of currency deposited. As noted above, where the self-service coin exchange machine 10 is networked, such information is advantageously transmitted to a remote database. The captured serial number is also advantageously associated with some form of patron identification, such as an inserted patron card bearing information containing identity-related information or information that can be used to later determine identity, such as an account number of an identified financial institution that may later be tied to an individual. This tagging of deposited currency to a particular patron identifier, or even a particular machine, location, and/or time, has the potential to assist in subsequent investigations involving, for example, theft or fraud. In configurations where no patron identification is required, patron information data may be externally associated, for example, with external devices such as remote cameras. Thus, currency serial numbers for a given transaction can be associated with a particular machine and time and may be stored in association with an image taken from a local (e.g., machine resident) or remote camera.

Thus, in accord with at least some aspects of the present concepts, one or more image scanners, bar code scanner(s), and/or other forms of scanner(s) can be optionally utilized in combination with the self-service coin exchange machine 10. The scanner(s) would be able to read, for example, store coupons or script issued by the stores or check MICR data. In one aspect, the scanner(s) would be able to accept coupons issued by Safeway towards the purchase of goods at the store and issue a universal coupon or stored value card providing a compilation of the coupon identification codes and amounts, thereby enabling the patron to present a single coupon or card for scanning at the point of sale for application to the purchase of like goods. In some aspects, a separate coupon account may be opened for the patron by the self-service coin exchange machine 10 or separately at a service desk or even on-line. The patron can then scan the coupons at a self-service coin exchange machine 10 or other designated location and the coupon information would be uploaded into the patron's coupon account. Whenever a coupon is set to expire, the coupon data may be automatically removed from the patron's coupon account. When a patron presents the coupon card at a POS terminal in conjunction with a transaction, any product codes corresponding to product codes listed in the patron's coupon account would automatically trigger the applicable discount to be applied to the patron's transaction balance and the data associated with that coupon would be voided from the patron's coupon account. It is to be noted that the patron coupon account and patron coupon card are concepts that may be utilized independently of any self-service coin exchange machine 10.

As noted above, the self-service coin exchange machine 10 may be advantageously equipped with a check scanning module. The patron would then be permitted to write a check for up to a certain predetermined amount, the predetermined amount possibly being a variable amount based on the patron's credit history, past history with the store, account balance in the store network, status, provision of reserve credit information against which potential disputes could be resolved, etc. This service might be provided only to pre-approved or participating patrons. In some aspects, the patron would begin by swiping or inserting their store card (e.g., Costco), bank card, credit card, or other card having unique identification characteristics to identify themselves. The patron could then present a check payable to the store (e.g., Costco) and the check would be scanned by the check scanning module and validated. The patron would then receive payment in a medium or mediums including, but not limited to, currency, coupons, script to be used at the store, stored value cards, and/or a store value card for use uniquely at the store in which the self-service coin exchange machine 10 is disposed or at participating merchants (e.g., Starbucks, McDonald's, etc.).

Although described above in relation to communicatively linked or linkable coin exchange machines 10 connected to or configured to be connectable with an external network, computer, controller, system, service, terminal, node, communication device, such as a cellular telephone or paging device, or other electronic device, such as a PDA or data storage device, coin exchange machines 10 in accord with the present concepts may also comprise stand-alone machines (e.g., a machine not connected to an external network, computer, controller, system, service, or communication device). Thus, a coin exchange machine 10 in accord with some aspects of the present concepts may simply accept coin in, and optionally bills or documents (e.g., bills, checks, etc.), and dispense to a patron an amount of bills, bills and coins, or other combination of media, in an amount related to the total amount of processed coins.

Transaction related data, in lieu of being transferred to a remote site, a site different from the one in which the self-service coin exchange machine 10 is situated or in addition to being transferred to a remote site, may be stored in a local memory device either disposed in the self-service coin exchange machine itself or in a local device communicatively coupled to the self-service coin exchange machine. The local memory device would accessible to authorized employees of the store, bank, or establishment within which the self-service coin exchange machine 10 is disposed.

In at least some aspects, the self-service coin exchange machine 10 communicates transaction data and/or servicing requirements or problems to local and/or remote persons or computers by way of, for example, text messaging, facsimile communication, electronic mail, and/or paging devices. Likewise, the currency dispensing module 110, stored value media dispensing module 120, and/or the document processing module 130, may utilize the communication interface of the self-service coin exchange machine 10 or may comprise a separate communication interface, the communication interface being configured to permit the currency dispensing module 110, stored value media dispensing module 120, and/or the document processing module 130 to communicate with other connected local and/or remote computers. For example, the currency dispensing module 110 could communicate to a local and/or remote computer transaction data and/or servicing requirements or problems such as, but not limited to, a jam of a currency dispenser, low currency of a particular denomination, low currency of one or more denominations, low receipt paper, unlocking of access door to currency dispensing module, opening of access door to currency dispensing module, movement of or mispositioning of multi-cassette dispenser or single-denomination dispenser, abnormal current draw or voltage requirement of electrical component, abnormal range of movement of moving part, or component out of tolerance. Thus, the currency dispensing module 110 could comprise or utilize a communication device (hardwired or wireless) to transmit information from the currency dispensing module to a local and/or remote computer and/or person to convey to such local and/or remote computer and/or person a status of the currency dispensing module. Similarly, the stored value media dispensing module 120 and/or the document processing module 130 could comprise or utilize a communication device (hardwired or wireless) to transmit information from the stored value media dispensing module 120 and/or the document processing module 130 to a local and/or remote computer and/or person to convey to such local and/or remote computer and/or person a status of the stored value media dispensing module 120 and/or the document processing module 130, respectively.

Alternatively or in addition to the noted communication(s), lights on or above the self-service coin exchange machine 10, currency dispensing module 110, stored value media dispensing module 120, and/or the document processing module 130, messages on the corresponding display(s), and/or audible signals may be utilized to inform the authorized employees of the store, bank, or establishment within which the self-service coin exchange machine 10 is disposed of any servicing requirements or problems.

In a stand alone coin exchange machine 10 configuration, wherein the self-service coin exchange machine 10 is not electronically monitored, security features may yet be implemented to enhance security of the machine and discourage attempts at fraud. In one such optional aspect, each patron desiring to use the self-service coin exchange machine 10 must first be registered to use the machine.

Registration may be accomplished in any manner, such as by issuing the patron a store patron card (e.g., a "Jewel card"), a bank card (e.g., a debit or credit card), or a personal identification number (PIN). The self-service coin exchange machine 10 is, in some aspects, configured to recognize one or more of such types of cards or registration sources, such as a encrypted or non-encrypted information stored on or coded in such cards relating to the patron's identify and/or account number with the store or bank. Concurrent with each transaction performed at the self-service coin exchange machine 10, an electronic and/or printed audit trail would be generated and maintained for each transaction. Thus, if there was a dispute over the results of a transaction, if there were a suspicion of fraud, authorized employees of the store or bank could go back to the audit trail and relate the deposited coins to a specific patron or user. In alternative registration schemes, a patron lacking a pre-approved bank card or store card could go to a service desk in a store or a teller window of a bank, or the like, or even another kiosk, to register to use the stand alone coin exchange machine 10. Following registration, which would include entry of information including, but not limited to, a name, a valid address, a phone number, or the like, the patron would then be issued a card or device bearing such registration information.

The registration process would preferably, but not necessarily, include independent verification of the entered information, such as by a store employee or teller comparing the entered information to a government issued identification card (e.g., a driver's license). Alternately, the patron could be issued a unique encrypted card, ticket, or code by an employee, teller, or kiosk for use on the stand alone coin exchange machine 10 for an unlimited number of transactions, a predetermined number of transactions (i.e., one or more transactions), or until such card, ticket, or code is manually disabled by an employee, teller, or disabled in response to a disabling event (e.g., misuse of the card of coin exchange machine 10 by a patron). For example, a bank or store could disable a patron's card via a supervisor mode in the stand alone coin exchange machine 10. The supervisor use the display and/or other user interface(s) to locate the authorized card/ID listing and manually disable cards/IDs which were to be discontinued. After the specific patron cards/IDs were so disabled, the stand alone coin exchange machine 10 would no longer permit a patron entering such patron card/ID to utilize the self-service coin exchange machine.

In the stand alone configuration, remote verification of the data would not be possible in real-time. Therefore, the self-service coin exchange machine 10 would be limited to merely performing a check of the registration information to ensure that it met certain predefined parameters and such system could not independently verify that the patron presenting the registration information is, in fact, the person associated with the registration source.

Although the aforementioned self-service coin exchange machine 10 ably serves as a stand alone machine, the self-service coin exchange machine is, as noted above, also advantageously utilized on a network, such as a local area network (LAN), wide area network (WAN), Internetwork (i.e., interconnected networks use the Internet Protocol, such as a Intranet, Extranet, or Internet). Certain functions or transactions, such as those noted below, may also utilize near field communications and personal access networks (PANs). Further to the patron-centric benefits of electronic transmission of transaction data to a patron account, noted above, the networking of the self-service coin exchange machine 10 provides other attendant benefits to the owner, operator, or beneficiary of the self-service coin exchange machine. As one such benefit, networking permits real-time tracking of, and even authorization of, transactions executed or attempted to be executed on the self-service coin exchange machine. For example, a patron desiring to use the self-service coin exchange machine 10 could swipe their card for the store or bank through an associated card reader in the self-service coin exchange machine or could enter a pre-approved PIN or access number. The self-service coin exchange machine 10 then, prior to permitted the transaction to proceed, accesses the network to confirm that the data on the card, PIN, access code, registered biometric characteristic input, or the like, is for an active and authorized patron. The network would then provide authorization to the self-service coin exchange machine 10 to proceed with the transaction. Likewise, without authorization, the self-service coin exchange machine 10 would be unable to begin the transaction and would inform the patron of the problem or inform the patron that assistance was required.

As one example of a network to which the self-service coin exchange machine 10 could be connected, a large retail group such as Safeway may have their own proprietary network between all of their stores throughout the United States. If a patron has a Safeway Store card containing a patron account number, the retail group (or sub-portion thereof such as an individual store or regional entity) can utilize one or more self-service coin exchange machine(s) 10 in numerous promotional ways. For example, a patron might earn Safeway points each time they utilize the self-service coin exchange machine 10. The patron begins coin exchange transaction by swiping their Safeway card through a card reader or inserting their Safeway card in a card reader. The patron may then accumulate Safeway points, such as a fixed amount of points for each transaction or a variable amount of points related to a total value of the processed coins, such as a fixed point value per dollar deposited into the self-service coin exchange machine. For example, a deposit of $100 into the self-service coin exchange machine 10 could provide the patron with 100 points utilizable toward the purchase of goods, or discounts, at Safeway at a current or future date. In other words, the total benefit provided to the patron would exceed the $100 deposited. After the patron collects enough points the patron may be able to purchase a certain amount of goods and/or may receive certain discounts on goods or other incentives. Further, as one option, once a certain threshold of points or other tracking units has been achieved, further transactions at any of the networked coin exchange machines 10 may be waived. Similarly, in at least some aspects of the present concepts, if a patron is a store club member or otherwise possesses a preferred status at a store, the store may optionally elect to redeem the entire gross amount of the coins processed, opting to waive any transaction fee or commission for coin transactions performed by patrons who are store card members.

Networking of the self-service coin exchange machines 10 confers additional advantages to the patrons using the self-service coin exchange machines. For example, the network hosting the self-service coin exchange machines 10 may optionally include an account server(s) or service(s), or the like, that enables patrons to maintain an account in association with the network and/or store or chain to permit the patron to retain coin deposit balances in the self-service coin exchange machine network for redemption or withdrawal at a time of the patron's choosing. As noted above, the network need not be affiliated with a particular store or chain and may be run by a third party independent of the store in which the self-service coin exchange machine 10 is housed. In at least some aspects, a patron is uniquely associated with an account in the self-service coin exchange machine network, store network, or other associated network, such as by a store card (or other cards such as ATM card, etc.), biometric input, or other identifying information. For example, where the network is associated with a store, the store may allow the patron to retain balances for coin deposited at their patron account number within the store. Thus, in that example, a patron depositing coins having a redemption value of $100 at Safeway Store #1 in the morning could opt to credit the $100 redemption value into a coin exchange machine to the identified patron's store account for later use by the patron. Several days later, the patron is at the same Safeway store, or at another Safeway store or at another participating store or business and, at that time, presents their store card at the point of sale checkout counter, service desk, or redemption kiosk. The point of sale checkout counter may be staffed or self-service. At that time, the patron instructs the self-service point of sale terminal, or requests the store employee at the staffed point of sale terminal or service desk, to draw on the $100 credit associated with the patron's store account toward the purchase of merchandise. In another example, following processing of the coins at the self-service coin exchange machine 10, the patron is permitted to allocate a portion of the deposited coin value, minus any applicable optional transaction fee, for immediate disbursement in currency from the currency dispensing module 110 and a remainder of such deposited coin value is retained in the store account in association with the patron. Thus, in the above example, the patron depositing coins yielding a $100 redemption value could opt to receive $60 in cash at the time of the coin exchange transaction and leave the balance of $40 on their store account for later use.

Still further, a plurality of self-service coin exchange machines 10 may be linked together in a network independent of any participating store, bank, or business in which the self-service coin exchange machines may be disposed. Thus, hundreds or thousands of self-service coin exchange machines 10 may be disposed in dozens of different stores (e.g., Safeway, Costco, Target, etc.). The patron performing the transaction may opt to uniquely associated their deposited amount with a account number, such as by identification through a patron's card bearing unique identifying information, biometric input, or the like. Thus, a patron depositing coins yielding a $100 redemption value at Safeway Store #1 in the morning could opt to associate the $100 redemption value into a coin exchange machine to the patron, such as by inserting or swiping a card bearing information uniquely identifying the patron (e.g., a bank card, store card, etc.) or by inputting biometric data (e.g., finger scan), for later use by the patron. Several days later, the patron is at the same Safeway store, or at another Safeway store or at another store or business (e.g., Costco, Target, etc.) having a networked self-service coin exchange machine 10 and, at that time, presents their store card at the point of sale checkout counter, service desk, or redemption kiosk. The patron instructs the self-service point of sale terminal, or requests the store employee at the staffed point of sale terminal or service desk, to draw on the $100 credit associated with the patron's store account toward the purchase of merchandise. Likewise, the patron processing coins at a store's self-service coin exchange machine 10 may opt to receive a portion of the redemption value of their coins, less any applicable transaction fee, and reserve a portion of the redemption value in the account of the networked self-service coin exchange machines for later use. The patron in the above example having a $100 redemption value may then, for example, take $75 in cash at the time of the transaction and leave the balance of $25 on the account of the networked self-service coin exchange machines.

Another benefit to networking of the self-service coin exchange machine 10 is that the owner, operator, or beneficiary of the self-service coin exchange machine 10 may set limitations on transactions. For example, a store or a bank might automatically authorize pay outs of up to a predetermined pay out amount, such as $150, at any self-service coin exchange machine 10 location in the network, but might require any pay out greater than $150 to be attended to by a supervisor who would independently verify that the transaction is valid prior to approving a pay out larger than the predetermined amount. Although stand-alone coin exchange machines 10 may also be set to provide this same function, on an individual basis, the providing of the network enables the owner, operator, or beneficiary of the self-service coin exchange machine 10 to change this limit on a day-to-day basis, upon the occurrence of predetermined conditions, or at will. For example, an owner, operator, or beneficiary of the self-service coin exchange machine 10, such as a bank or financial institution, may vary the predetermined maximum unattended pay out amount upwardly and/or downwardly over time (e.g., from $150, to $200, back to $150), or may vary the predetermined pay out amount in accord with the time of the day (e.g., day vs. night) on a schedule, entirely at its discretion. As another example, the predetermined pay out amount could be tied directly to the patron. In other words, a patron having good balances at a bank or a patron having a good record of past transactions at a store and/or on the self-service coin exchange machine 10 may be allowed to deposit as much as $500 in coin and receive immediate pay out through the currency dispensing module 110, whereas a patron lacking a sufficient record of past transactions at a store and/or with the self-service coin exchange machine might be limited to a predetermined pay out amount of $100. The predetermined pay out amount could also be set to vary from one coin exchange machine 10 location to the next based upon demographics and security considerations.

As noted above, a plurality of self-service coin exchange machines 10 may be connected together in a network. The network may be managed by a company (e.g., Safeway) in whose stores the plurality of self-service coin exchange machines 10 are disposed or may be managed by a third party hired by the company or managed by a third party independent of such company. For example, such independent third party can lease the self-service coin exchange machines 10 to one or more companies and both manage the network of self-service coin exchange machines and perform service calls on the self-service coin exchange machines to fix the machines, maintain the machines, or to load and/or reload the machines.

The network encompassing a group of self-service coin exchange machines 10 may advantageously be accessible directly through POS terminals at participating retail locations. In other words, each of the participating retail locations would share the same network and would have access to the same account information on their shared network. The POS terminals would permit such participating retail locations to directly access identified patron's accounts on the network and draw down against the value balance towards the purchase of merchandise or services at that participating retail location. The patron may be identified uniquely to an account in the shared network by, for example, a value card (magnetic stripe card, smart card, optical card, etc.) dispensed by, or coded by, a self-service coin exchange machine 10. The participating retail locations need not themselves even utilize self-service coin exchange machines 10, although they certainly could do so. Instead, the availability of the shared network to a plurality of participating retail locations benefits both the owner/lessor of the self-service coin exchange machines 10, by encouraging its use, and the participating retail locations, by providing still additional forms of currency transfer by which patrons can conduct business. A POS could, for example, have a payment key or touch key on a touch screen dedicated to a transaction conducted on the shared network wherein activation of the key prompts the cashier or employee to input the patron's unique identification or to have the patron input his or her unique identification (e.g., biometric input, card swipe, etc.). The POS sends this identifying information to query the shared network for a match and, should a match be found, the transaction is reconciled against the identified account. To illustrate one example, a self-service coin exchange machine 10 disposed in a Costco is associated with a shared network managed by some party or entity (e.g., Costco, a company leasing out self-service coin exchange machines, an agent of Costco, a third party, etc.) such network being accessible by participating merchants (e.g., Starbucks, McDonalds, Apple Music Store, Borders, Exxon, etc.). The value of the coin exchange transaction conducted at the self-service coin exchange machine 10 would be associated with or stored on a value card dispensed from a card dispenser of the self-service coin exchange machine 10. At a later time the patron would visit a participating merchant location (e.g., Starbucks) and, in association with a transaction at that participating merchant location, present their value card. The cashier would designate to the POS terminal, by appropriate input, that the transaction involved the shared network and then the patron's value card would be swiped through the POS terminal of the participating merchant location. The POS terminal would access the shared network and query the shared network to determine if the amount of credit available to the patron in the patron's account is sufficient to cover the amount of the transaction in question. If the amount of credit available to the patron in the patron's account is sufficient to cover the amount of the transaction in question, authorization for the transaction would be transmitted by the shared network to the participating merchant location and the patron's account would be debited by the amount of the transaction.

Regarding the dispensing of value cards from a self-service coin exchange machine 10 dispenser, certain third parties (e.g., Blackhawk Network, InComm, GiftClixx, etc.) established by Safeway Inc. in 2001) integrate merchant's value cards and offer a plurality of branded retail gift cards (e.g., Barnes & Noble, iTunes, Starbucks, American Express, MasterCard, Visa, etc.). The value card issuers pay a commission for the cards that are sold on their behalf. Therefore, the self-service coin exchange machine 10 may be advantageously integrated into the Blackhawk Network accounting system through a communication interface. Then, following processing of coins and/or cash deposited in the self-service coin exchange machine 10 and application of any applicable transaction fees to determine a value for the transaction, such value is transmitted to the Blackhawk Network accounting system, the value is associated with a value card selected by the patron, and the selected value card is dispensed to the patron. In another configuration, if the self-service coin exchange machine 10 is not configured to dispense value cards, the value of the transaction (or portion thereof designated by the patron) may be alternatively directed to a patron account accessible at a POS terminal or printed out in a restricted use ticket bearing a bar code encoded with data comprising the value that the patron desires to allocate to a value card. The patron would then retrieve a blank (no value) branded value card from a Gift Card Mall™ or the like to take to a POS terminal in the retail location for activation. In connection with an activation of the branded value card at a POS terminal, the patron's account may be accessed by the cashier or employee, through appropriate input identifying the patron to the patron's account (e.g., magnetic card swipe, biometric input, etc.), and the amount to be applied to the branded value card transferred to the Blackhawk Network (or similar entity, as appropriate). Alternatively, where a restricted use ticket bearing a bar code encoded with value data is provided to the patron by the self-service coin exchange machine 10, the patron may present this restricted use ticket to the cashier or employee at a POS terminal in conjunction with the activation of the branded value card, at which time both the branded value card and the restricted use ticket are scanned and the value associated with the restricted use ticket is transmitted.

In another scenario, the patron is identified uniquely to an account in the shared network by, for example, a PIN number, a debit card, credit cards, store cards, biometric characteristic, etcetera. Before, during, or after the processing of the coins by the self-service coin exchange machine 10, the patron inputs a PIN number, a debit card, credit card, store card, biometric characteristic, or the like, with an instruction to allocate at least a portion of the total value of the processed coins to an account associated or to be associated with an account or to an existing account associated with the same identifying information. In this regard, a patron may have an existing account on the shared network, the account being associated to the patron by the patron's Costco Member Card or, more particularly, to the track 1 data thereon, the track 2 data thereon, some combination of the track 1 and track 2 data, or an encrypted version of the track 1 data and/or track 2 data. When the patron later presents his or her Costco Member Card at another location, such as a Starbucks, the cashier or employee at Starbucks can designate at the POS terminal that the transaction is to utilize the shared network. The scanned card data is then compared by the shared network to corresponding identifying information in the shared network to identify a match with an existing account and, should a match be found, reconcile the transaction against the identified account by debiting the account in the amount of the transaction and authorizing the transaction. Thus, as noted above, a plurality of participating merchants are able to go a central record and draw down against the value balance towards the purchase of merchandise or services at that location.

A company utilizing a plurality of self-service coin exchange machines 10 may also, of course, maintain a closed network accessible only within the company and/or to authorized users (e.g., LAN, WAN, intranet, extranet, etc.). For example, Costco can maintain a network for a legion of self-service coin exchange machines 10 and share data across all of their store locations throughout the entire network or across designated geographic areas. Further, the connected self-service coin exchange machines 10 can not only perform coin transactions or open or add value to a Costco patron's account, but can also perform other transactions and transmit appropriate data across the network. As above, a patron conducting a coin exchange transaction in which the patron desires that a portion of the total value of the processed coins would identify himself or herself to the self-service coin exchange machine 10, such as by inputting or swiping their Costco card, bank card, credit card, or driver's license (e.g., where provided with a magnetic strip), or by placing an electronic fob in proximity to a corresponding sensor, inputting a biometric input, or the like. At a later date, the patron enters the same store, or another store within the company network, and provides an identifying input to the self-service coin exchange machine 10, service desk, or point of sale terminal to thereby access the patron's account in the network and utilize those funds toward a transaction at the store. In another example, a week later the patron may enter the same store or a second store at another location, approach the self-service coin exchange machine 10, service desk, or point of sale terminal to thereby access the patron's account, and instruct the machine or employee, as appropriate, to pay out the balance or a portion of the balance, in cash. Thus, the patron is provided significant flexibility as to when they are able to withdraw their funds from their account.

In other aspects, a self-service coin exchange machine 10 is configurable to accept payment by patrons to utilities, governmental entity (e.g., tax authority, licensing authority, etc.), lenders (e.g., monthly payment for an auto loan, payment on a credit card balance, etc.), or identified third party (e.g., a wire transfer to an identified account anywhere in the world). The appropriate utilities, governmental entities, lenders, etc. would advantageously be networked to the self-service coin exchange machine in order to perform this function, but alternatively be accessible via a hardwired or wireless communication link. The payment may occur via a coin exchange transaction wherein a patron elects to effect such funds transfer (e.g., to pay a utility bill) by depositing coin and/or currency into the self-service coin exchange machine 10 and by identifying the appropriate account or patron ID. For example, where the self-service coin exchange machine 10 is configured to accept payments for a local electric utility, a touch key is provided on the touch screen display and the patron can select the option of payment to the local electric utility, at which point the patron would be prompted to enter, and preferably verify following entry, the utility ID number for the patron. The patron would preferably then be asked to confirm the particulars of the transaction and then proceed to authorize the transfer of funds. As one example, where a patron's utility bill is $90.00 and the patron's deposit is $100.00, the patron could allocate $90 toward the utility bill. Alternately, if the patron's deposit of coins totals only $50.00, the patron could deposit additional funds to cover the difference. The deposit of additional funds could be from a variety of sources including, but not limited to, a deposit of cash into a bill acceptor, a deposit of funds from a stored value card, insertion of a check into a scanning module, or the like. As discussed herein, deposited checks may be stored in a separate check cassette.

In still additional aspects of the present concepts, the self-service coin exchange machine 10 is configured to generate a money order for at least a portion of the amount of coin/currency deposited by the patron and to transmit information relating to the money order to a local computer and/or remote computer.

Further, as noted above, owing to the networked arrangement, the self-service coin exchange machine 10 may, whatever the location, provide alterative forms of splitting the dispensed value between a variety of forms including electronic transfers to a patron account and electronic transfers to a third party account (e.g., a creditor of the patron). Because the self-service coin exchange machine 10 is, in some aspects, connected to a network, patrons, particularly bank patrons, can utilize the self-service coin exchange machine 10 to pay bills. For example the patron may deposit $150 in coin and use this full balance to pay bills directly (payment to third party creditor) or indirectly (maintaining sufficient balance in bank account to cover automatic withdrawals from account from authorized third party creditor). Alternately, patrons may receive some portion of the deposited amount in cash and may use the remainder to pay a bill for a creditor, deposit money to an account (e.g., a store account, bank account, etc.), or to donate to an intended beneficiary such as, but not limited to, payment of a utility bill (e.g., electric, water, etc.), parking tickets, purchase of money order, payment on a bank loan, pay down a credit card balance, a municipal garbage bill, or such as a donation to a designated charity.

Where a donation to one or more charities is an option available to a patron, the sponsoring store may reduce the service fee or waive the service fee entirely when a donation is made to charity. Thus, the patron could split the value of exchanged coins between a deposit at a bank, a donation to charity, and currency return to the patron. The patron could also designate some of the value of the exchanged coins toward acquiring a stored value card or crediting a part of the value of the deposited coins to the patron's store account number.

In some networked coin exchange machine 10 configurations, the network may optionally be used to selectively enable the self-service coin exchange machine to work with only approved portable data storage devices (e.g., magnetic strip cards, smart card, fob, smart cards, cell phone, electronic wallet/purse, implanted/subdural microchip, etc.). Thus, patrons could take their cell phone to a designated place or person in the store or bank or other location and register their cell phone, or other portable data storage device, for use with the self-service coin exchange machine 10. Once the cell phone ID has been registered in the network, a receiver on the self-service coin exchange machine 10 would then be enabled to recognize that cell phone and correspondingly authorize transmission of value to that cell phone. Preferably, due to the prevalence of electronic devices, the self-service coin exchange machine 10 user interface would prominently prompt the patron to confirm the recipient location of the target electronic device. For example, the display could display the cell phone number of the device to which the value is to be transferred following a confirmatory input by the patron. In another example, a picture of the patron may be taken at the time that the portable data storage device is registered in the system and the patron's picture stored in association with the identified and registered portable data storage device. Thus, when the self-service coin exchange machine 10 user interface displays to the patron the target registered portable data storage device, the patron can see his or her picture next the identified device to provide additional assurance that the patron is transferring the value to his or her own data storage device. In still other aspects, the portable data storage device may itself be cross-referenced to a patron's checking account(s), saving account(s), or other databases or accounts, such as a patron's ID number at a store or store account.

Once the identity of and registration of the portable data storage device is confirmed by the self-service coin exchange machine 10, the patron can deposit transfer value thereto or, alternatively, select from any of the above-described options including, but not limited to, receiving some or all of the value of the processed coins back in cash, make payments on utility bills, transfer money to a checking or savings account, receiving a value-bearing card, receiving a card associated with a value, etcetera. For example, a patron having processed $100 in coins could input a request to the self-service coin exchange machine 10 to transmit the value of the coins received into a registered cell phone, electronic wallet, microchip, or other type of portable data storage device using any appropriate transmission medium (e.g., near field communication, carrier waves, etc.). Once the total value of the processed coins, or value relating thereto (e.g., the total value minus any transaction fee or other fee), has been dispensed to the patron or transferred to a designated destination, such as described above, the transaction is closed out and a receipt optionally issued.

Alternatively, in lieu of the above-noted registration of the patron's portable data storage device with a designated employee or at a designated location in the store, bank or other location in which the self-service coin exchange machine 10 is disposed, a stand-along embodiment of the self-service coin exchange machine may be optionally configured to independently perform registration of a patron's portable data storage device and store such information locally on a memory device associated with the self-service coin exchange machine. Thus, a patron may register a cell phone configured as an electronic wallet directly with the self-service coin exchange machine 10 following establishment of communication between the cell phone and the self-service coin exchange machine through a wireless or hard-wired communication path. Once registered, the patron could use the registered cell phone as a destination device for electronic transfer of funds processed by the self-service coin exchange machine.

In at least some aspects of the above concepts, a patron desiring to allocate funds to a registered portable data storage device may be required to indicate such desire to the self-service coin exchange machine 10 at a beginning of the transaction, such as prior to coin processing.

Still additional aspects of the present concepts, particularly for networked coin exchange machines 10, but applicable nonetheless to stand alone coin exchange machines, include options for setting transaction fees. Utilization of a network to set fees permits the owner or operator of a plurality of coin exchange machines 10 to set fees for a plurality of coin exchange machines at the same time and reduces the time and labor that would otherwise be required to individually load such settings at each coin exchange machine. In at least some aspects of fee arrangements in accord with at least some aspects of the present concepts, the bank, store, owner, operator, or other person or entity controlling the self-service coin exchange machine 10 settings may set transaction fees according to a patron type. For example, a "premium" or "preferred" bank or store patron might not be charged any fees for use of the device. A known bank or store patron lacking a "premium" or "preferred" status may be charged a reduced fee or a nominal flat fee, such as 2%-3%. An infrequent client or patron may be charged a higher fee of 5%-6%. An unknown patron may be charged a full fee of 8%-10%. With a network connection, the self-service coin exchange machine 10 is able to access available databases to make these decisions if the bank or store so chose to utilize this option. Without such a network connection, the self-service coin exchange machine 10 would be able to make such decisions only upon information resident in the self-service coin exchange machine memory or upon information provided to the self-service coin exchange machine by the patron such as by input of a patron card bearing indicia of a "preferred" status.

There are many ways that the self-service coin exchange machine 10 (or associated network system) could "recognize" a patron, many of which, but certainly not all, are particularly suited to a networked configuration. In one rudimentary approach whereby the self-service coin exchange machine 10 is enabled to recognize a patron, a patron is required to go to a service desk or a teller to obtain a randomly issued number in order to utilize a device. This randomly issued number would then be transmitted to the self-service coin exchange machine 10, via a network or directly via a wireless transmission from the service desk or teller, to enable the self-service coin exchange machine to process a transaction upon entry of such number in a user interface device. After receiving the randomly issued number, the patron would go to the self-service coin exchange machine 10 and enter the randomly issued number to enable the self-service coin exchange machine, which would then complete the transaction including payment and cash. In other aspects, the service desk or teller issues to a patron a personal PIN or user ID number, which is optionally associated with the patron's presented identification. Where patron identification is not required, the fee structure for use of the self-service coin exchange machine 10 may optionally be influenced by a patron's volunteering such identification for association with the personal PIN or user ID number, such as by reducing or eliminating a standard transaction fee. For example, a typical 9% fee may be reduced by 5%.

In other aspects, the self-service coin exchange machine 10 (or associated network system) could "recognize" a patron, through a patron's card or other identification (e.g., government issued identification). For example, the patron would have to swipe a credit card such as a VISA, or a store card, or bank card, or the like, to provide proof of identity. Utilizing know verification methods and systems, the credit card information stored on the magnetic strip (or other data storage medium) thereof may be decoded or decrypted and information borne thereby relayed to a database able to confirm the identity associated with the patron presenting such card or, alternatively, patron identification information stored directly on a data medium of the presented card itself is decoded or decrypted and passed to the self-service coin exchange machine 10 controller. Thus, in some aspects, a patron may swipe or enter a card bearing a patron's identity or being associated with a patron's identity before beginning a transaction. Following such entry of the identification information, the self-service coin exchange machine 10 would determine the status of the patron enable and/or assign a status to the patron (e.g., known (preferred), known, unknown, etc.) and conduct transactions (if at all) in view of such status.

In still other aspects, the patrons identification may comprise a cell phone ID number or a portable electronic device ID number. In such aspects, the self-service coin exchange machine 10 or network associated therewith would read or otherwise receive the cell phone ID number or a portable electronic device ID number and associated it to the patron ID and account numbers.

Yet other aspects of the present concepts envision the use of a camera (e.g., a CCD device) disposed on, in, or in the vicinity of the self-service coin exchange machine 10 to obtain an image of the patron. As described in U.S. patent application Ser. No. 11/726,828, entitled "System, Apparatus, And Methods For Currency Processing Control And Redemption" and having USPT and being assigned to the present assignee, which is incorporated herein by reference in its entirety, the image of the patron would be matched to a stored image of authorized patrons in a database of such images of authorized patrons. A match of the patron's image would, if successfully matched with one of the stored images of authorized patrons, permit use of the self-service coin exchange machine 10.

Another way in which the self-service coin exchange machine 10 could "recognize" a patron, is through bio-identification or biometrics. Under this approach, a patron would pre-register at a designated location, such as a help desk in a store or a teller at a bank, by providing a biometric characteristic by which the patron may later be identified, such biometric characteristic comprising, for example, a fingerprint scan for one or more than one finger, a nail bed scan, an eye scan, a voice print for a selected utterance, or other biometric characteristic. Once the patron's biometric characteristic is registered, the patron may then utilize any coin exchange machine 10 located anywhere in network, such as at an location of a bank or store having multiple locations, or only at a single designated location, depending on the parameters set by the store or bank. Thus, the patron's biometric characteristic registration serves as a pre-condition to use of the self-service coin exchange machine 10.

In certain aspects, the preconditioning of the use of the self-service coin exchange machine 10 on the patron's biometric characteristic registration may, instead, merely precondition the fee structure to be imposed on the transaction. For example, a patron engaging in a transaction on the self-service coin exchange machine 10 would not be charged a fee if the patron uses his or her biometric characteristic to enable the transaction, whereas a patron not using a biometric characteristic to identify himself or herself to the self-service coin exchange machine 10 is charged a transaction fee (e.g., a 5%-10% fee). Such a transaction fee may optionally be offset or eliminated by various other incentives for use or other fee-reducing potentials (e.g., "preferred" card, etc.) available to the patron.

In at least some aspects, the self-service coin exchange machine 10 is itself outfitted with the necessary biometric characteristic reading hardware, software, and/or firmware necessary to appropriately instruct a patron in how to ensure a proper reading of the biometric characteristic, to read and process the biometric characteristic, and to store the biometric characteristic locally and/or remotely.

Various aspects of fee arrangements encompassed by any of the disclosed concepts include, but are not limited to, tracking of the personal PIN or user ID number (or biometric characteristic or any other tracking device) and varying the fee charged for transactions based upon patron-specific information. For example, such tracking may include the tracking of and the frequency and/or total value of the transactions associated with that particular personal PIN or user ID number are stored locally (e.g., a stand alone coin exchange machine) or remotely (i.e., a networked coin exchange machine 10). As the patron's transaction frequency and/or total value increase over time, the transaction fee charged to that patron optionally decreases. Thus, in one example, for each $200 of coins processed in association with a patron number, the standard transaction fee is reduced by 1%, which reduction may stop at a predetermined point or may be permitted to eventually be reduced to zero. The reduction may also be graduated, rather than constant. For example, the first $100 of coins processed may produce an initial 1% drop in transaction fee for subsequent transactions, but to move to the next level and drop the transaction fee an additional 1% would require the processing of an additional $200 and still another reduction in the transaction fee by 1% would require the processing of an additional $250, or the like.

Networking of the self-service coin exchange machine 10 in the manner disclosed confers still additional advantages. In some aspects, larger stores and banks may easily network hundreds of coin exchange machines 10 together throughout a plurality of branch or store locations over the country and the transaction data for each machine, for selected groupings of machines, or for the entire population of machines may be tracked in real-time or trended. The self-service coin exchange machines 10 are managed over the network in groups, or even individually. For example, a first group of coin exchange machines 10, however such groups are defined by the owner or operator of the self-service coin exchange machines, are configured with one or more similar or dissimilar features, operating parameters, software, or the like, so as to be at least substantially the same (e.g., a first set of fees, a first set of restrictions on use, a first set of advertisements and/or attract screens, etc.). Likewise, a second group of coin exchange machines 10 are configured with a second set of fees, a second set of restrictions on use, a second set of advertisements and/or attract screens, etcetera. Similarly, even across the first and second group, an individual patron having a known or preferred status within the self-service coin exchange machine 10 network is permitted, by virtue of registration and patronage, to bypass the standard first or second configuration of the self-service coin exchange machine 10, to benefit from a third configuration that is commonly available to each of the self-service coin exchange machines in both the first group and the second group.

The networking of the self-service coin exchange machines 10 would still further permit remote management of widely dispersed coin exchange machines. Such remote management features may include, but are not limited to, machine parameter monitoring (e.g., trending) and service minder monitoring. Management software allows for local monitoring of one or more coin exchange machines 10 via a network (e.g., LAN or WAN) through a networked computer or through a web browser. For example, an Intranet may be provided wherein access is provided to a central computer or manager enabled terminal through a network gateway with a firewall, with appropriate provisions for user authentication and virtual private network (VPN) connectivity for off-site employees to access coin exchange machine information. In some aspects, the management software facilitates the creation of management reports from data obtained from one or more of the self-service coin exchange machines 10. A user of the management software may thus query directly the database of a coin exchange machine 10 via the management software for real-time management reports that reflect the machine's totals from the current day, specifics for an identified transaction, information for specified ranges of transaction numbers, statistics for a specified time period, maintenance or performance related data, or the like. Alternatively, such user of the management software may so query a network database containing data from one or more coin exchange machines. Additionally, the management software supports, further to information gathering, remote configuration of one or more of the self-service coin exchange machines 10, either over a network or directly through an internet connection.

Any component and/or system of the coin processing module which is amenable to monitoring (e.g., monitoring a voltage, current, position, pressure, temperature, response, and/or changes thereof over time) may be monitored and the monitored data transmitted to a local computer and/or a remote computer through a communication device employing a wireless or hardwired communication pathway and/or stored in a storage device such as a floppy disk, a flexible disk, hard disk, magnetic tape, any other magnetic medium, a CD-RW, DVD, optical medium, a RAM, and EPROM, a FLASH-EPROM, any other memory chip or cartridge. The storage device may include any conventional non-volatile media (e.g., optical or magnetic disks), volatile media (e.g. dynamic memory). The monitored data may also be transmitted from the self-service coin exchange machine 10 via a transmission media including, but not limited to, coaxial cables, copper wire and fiber optics, or carrier waves, such as acoustic or light waves generated during radio frequency (RF) or near field communication and infrared (IR) data communications. The transmission media may be thus be utilized not only to output data from the self-service coin exchange machine 10, but may be utilized for local or off-site communication to the self-service coin exchange machine 10. For example, the controller instruction set may be updated through the transmission media communications interface (e.g., I/O port, modem, LAN card, WAN card, 10b-t connector, etc.). As another example, certain coin processing module variables and set-points may be configured to be changed remotely.

The monitored data may be stored in a data storage medium (not shown) resident in or near the self-service coin exchange machine 10, or may be transmitted off-site to a remote location, such as the manufacturer of the self-service coin exchange machine or designated representative. The transmissions may be substantially continuous, intermittent, or on a schedule (e.g., daily or weekly transmission at a designated interval). The monitored data transmitted by the self-service coin exchange machine 10 controller may then be analyzed by designated personnel and/or diagnostic applications. The data may be processed to yield statistical data useful in trending analyses and may be used, for example, to predict failures before they happen or to trend non-obvious degradation in performance so that appropriate corrective actions can be taken prior to such predicted failure. As one example of non-obvious degradation, the monitored data may indicate a high level of discrimination counts in the self-service coin exchange machine 10, even though the transaction was ultimately successful.

In accord with some aspects of remote management, an owner or operator of the self-service coin exchange machine 10 is provided access to a server, either a patron-specific server or a network server accessible by patrons of the manufacturer or service provider, and all coin exchange machines maintained by the patron may call into the server, or be polled thereby, via the transmission media communications interface. Once the link has been established between the self-service coin exchange machine 10 and the server, or the like, the controller and resident memory of the self-service coin exchange machine may be updated (e.g., software updates, set-point updates) and monitored data and coin processing data (e.g., totals, counts, non-counts, etc.) uploaded/downloaded. The remote processing significantly provides the ability to perform unattended software updates. Such activities are advantageously performed during the night when the use of the coin processing modules is typically minimal.

The management software is, in some aspects, programmed so as to allow the management software to be accessed and utilized via a standard web browser. As such, according to some embodiments, the management software is designed to be utilized by a user using a browser, such as Microsoft's Internet Explorer browser. The server may include an Active Server Page (ASP) providing device independent functionality. Utilizing a standard browser, a user, having the appropriate privileges, can direct the browser to either the server's ASP or the coin processing module's ASP, which processes a user request, accesses one or more of the coin processing module's databases, and formats and presents the content to the user via the user's web browser. The ASP uses input received as the result of the user's request to access data from the self-service coin exchange machine's 10 databases and then builds or customizes the page on-the-fly before sending it to the user in a form that can be presented by the user's web browser. In this manner, the ASP is able to provide both the proper data and operational controls to the user in a device transparent mode.

Thus, the controller can transfer a portion of the contents of the local memory to the server for storage in a database associated therewith. In addition, diagnostics or management software located on the server may prompt the controller for specific information or may cause the controller to run a specific routine. In at least some aspects, the data transmitted by the self-service coin exchange machines 10 are transmitted and stored utilizing a proprietary encryption/decryption scheme. The management software may provide, for example, the ability to monitor the self-service coin exchange machine 10 current operational status, query system reports, allow for asynchronous system fault reporting, enable and disable the various transaction types supported by the self-service coin exchange machine, and perform maintenance from an external device, such as a remote or local computer.

The networking of the self-service coin exchange machine 10 therefore enables an owner or operator, such as a store or bank, to automatically update their accounting system and patron accounts on a real-time basis, if desired. Alternately, the network might call or poll the self-service coin exchange machine 10 periodically throughout the day (e.g., once or twice a day, every hour, etc.), or vice versa, to obtain all transaction data since the last time the self-service coin exchange machine was polled, or the data transmitted, and update records accordingly.

In at least some aspects of the present concepts, the self-service coin exchange machine 10 may be alternatively configured to dispense only tickets, rather than cash or cash and coin. Such a configuration would be particularly suited for casino or arcade applications, transportation applications, or at schools or universities. As discussed above, the self-service coin exchange machine 10 would accept input coins and optionally other value inputs and, in the presently described configuration, the self-service coin exchange machine would then dispense to the patron a restricted-use ticket. The restricted-use ticket bears a data storage medium, such as a magnetic strip, bar code or equivalent, or the like, singly or in combination, and preferably securely encrypted or encoded, by which the value associated with the restricted-use ticket may be identified and exchanged. In some aspects, the restricted-use ticket may bear a plurality of bar codes and/or magnetic strips, each of the bar codes and/or magnetic strips each bearing a different encryption and/or coding to further ensure the security of the restricted-use ticket. Approved exchange locations (e.g., slot machine) would, correspondingly, be configured with software necessary to decrypt and read the underlying information on the restricted-use ticket or would be networked with a central server or service configured with software necessary to decrypt and read the underlying information on the restricted-use ticket. The bar codes and/or magnetic strips discussed above may include the same information, so that the data borne thereby may be compared directly to one another upon decryption or decoding, or may include different information, which is assimilated at the exchange location (e.g., at a slot machine).

While security protections (e.g., encryption) resident on the restricted-use tickets may be sufficient to largely or entirely eliminate fraud of the restricted-use tickets, additional security may optionally be provided by transmitting data relating to each ticket issued (e.g., amount, code number(s), encryption protocol(s), key(s), restrictions, etc.) from the self-service coin exchange machine 10 to a central location. Not only would this configuration provide for tracking of tickets and alternative means for validation at the exchange location (e.g., a slot machine), but this would also permit use of rotating encryption techniques. In other words, a coin exchange machine 10 may be configured to generate tickets using any random or pre-determined combination of a plurality of available encryption or coding techniques (e.g., selected from a group of 10, 20, etc.).

The restricted-use ticket also preferably bears a visual indication of value as well as exchange information or instructions for the restricted-use ticket and also preferably includes security features (e.g., watermarks, thermochromic ink, pressure sensitive ink, holograms, etc.) to discourage and prevent counterfeiting.

The restricted-use ticket would bear a value relating to a total value of the processed coins, plus any optional additional input value, but would be limited exchange limited in scope. The patron could only exchange the ticket for the value associated therewith at specified locations. In a casino environment, the ticket may be valid only for use with approved slot machines, wagering games, third party vendors within the casino, or services offered by the casino or third party vendors therein. In an arcade application, the ticket may be valid only on games in the arcade. In a university environment, the ticket may be valid only for use for payment of university fees or for payment to approved vendors (e.g., bookstore, dining hall, on-campus fast food vendors, etc.). Alternatively, the restricted-use ticket could be exchanged in any entity affiliated with the issuing location, such as sister casinos in the example of a casino ticket. Therefore, the self-service coin exchange machine 10 comprises, in some aspects, a machine that just accepts bulk coins and issues a restricted use exchangeable ticket, as noted above. Alternately, the self-service coin exchange machine 10 is, in other aspects, a machine that accepts coin and currency, either one note at a time or in bulk, and issues a restricted use exchangeable ticket. In still further aspects of the present concepts, the self-service coin exchange machine 10 is configured to accept bulk coin and, optionally, currency, and to dispense any combination of coin, currency, and restricted use exchangeable ticket.

In any of the above described aspects of the present concepts, the coin processing machine 10 is optionally configurable to issue a receipt, either automatically or upon the request of a patron. Further, in lieu of a printed receipt, the coin processing machine 10 in any of the above described aspects may be configured to provide an electronic receipt and email the receipt to the patron or electronically transfer the receipt or like information relating to the transaction to a portable electronic device.

The aforementioned concepts provide various aspects wherein a patron is able to input a batch of loose mixed or single denomination coins, of one or more currency types, and the self-service coin exchange machine is able to total the input coins and substantially immediately dispense to the customer bills, coins, and/or other stored value media having a combined value relating to the total. Alternatively, the patron may be presented by the self-service coin exchange machine with one or more prompts for a user input that would delay the dispensing of the bills, coins, and/or other stored value media such as, for example, where the patron desires a particular allocation of the funds due between different options.

Figure 3:
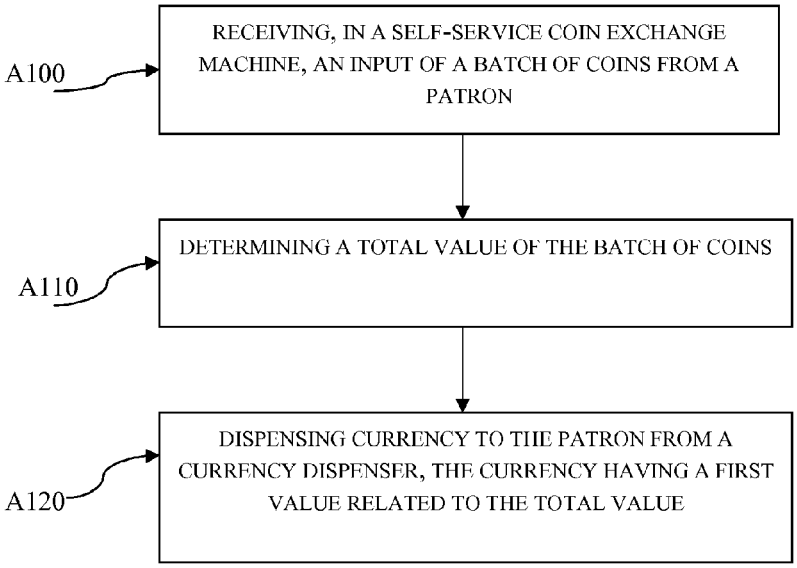
FIG. 3 shows aspects of one method in accord with at least some aspects of the present concepts.

In accord with various methods of the present concepts, FIG. 3 shows one method comprising the acts of receiving, in a self-service coin exchange machine, an input of a batch of coins from a patron (act A100), determining a total value of the batch of coins (act A110), and dispensing currency to the patron from a currency dispenser, the currency having a first value related to the total value (act A120).

Figure 4:
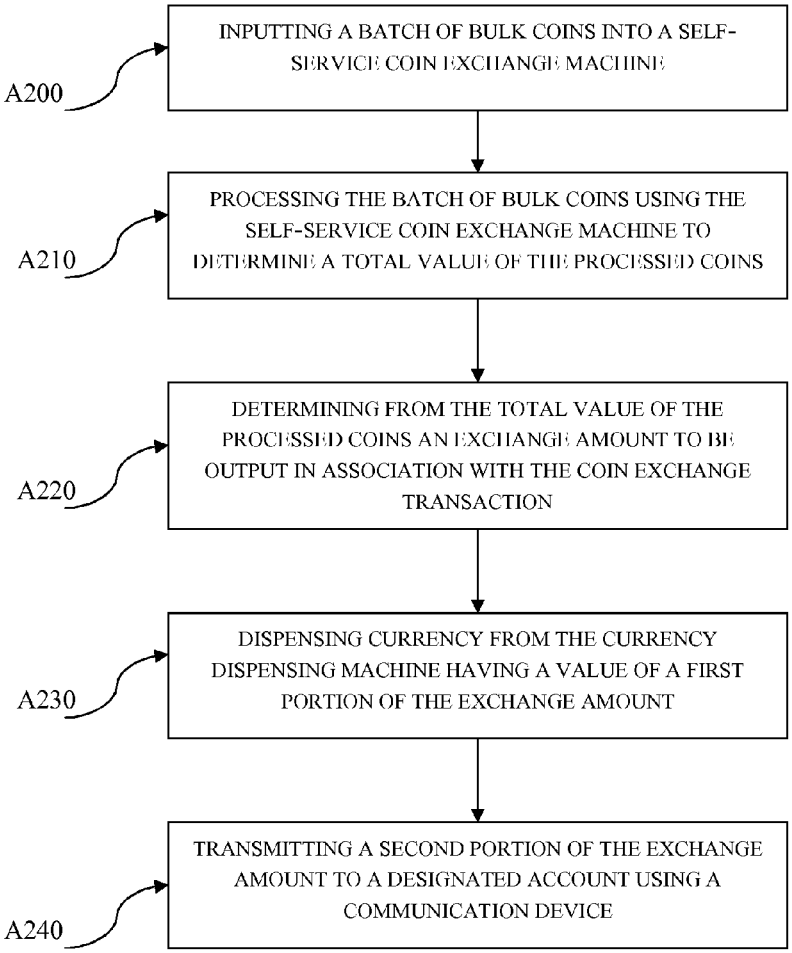
FIG. 4 shows aspects of one method in accord with at least some aspects of the present concepts.

FIG. 4 shows yet another method in accord with aspects of the present concepts, including the acts of inputting a batch of bulk coins into a self-service coin exchange machine 10 (act A200), processing the batch of bulk coins using the self-service coin exchange machine 10 to determine a total value of the processed coins (act A210), determining from the total value of the processed coins an exchange amount to be output in association with the coin exchange transaction (act A220), dispensing currency from the currency dispensing machine (e.g., currency dispensing module 110) having a value of a first portion of the exchange amount (act A230), and transmitting a second portion of the exchange amount to a designated account using a communication device (e.g., 102) (act A240).

Figure 5:
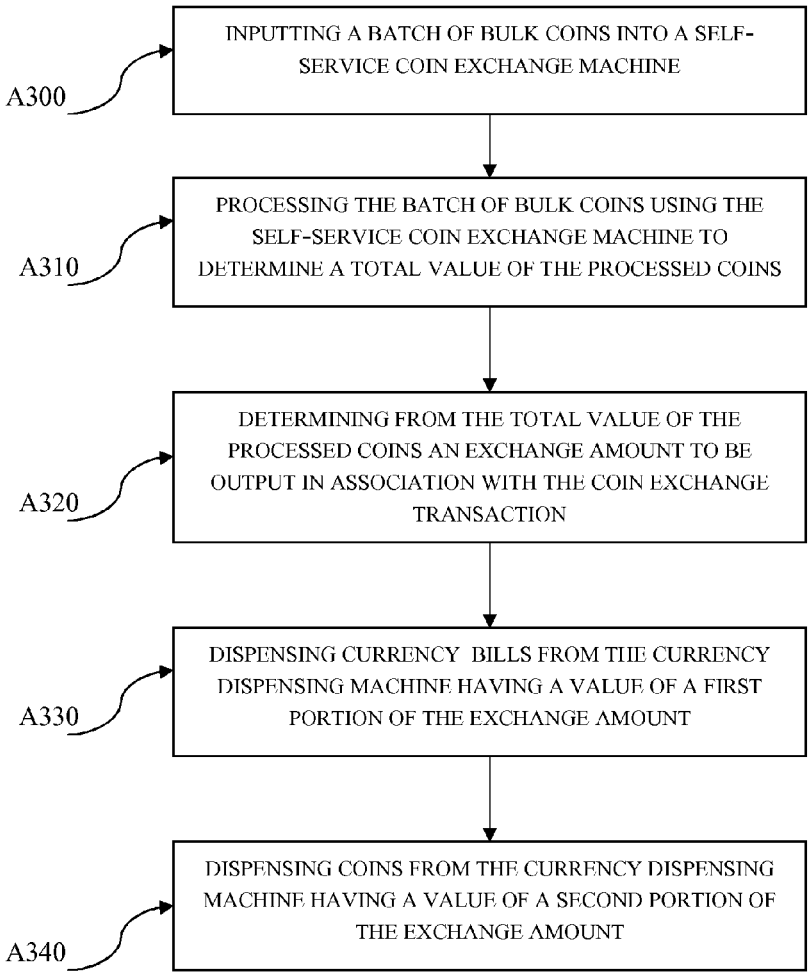
FIG. 5 shows aspects of one method in accord with at least some aspects of the present concepts.

FIG. 5 shows another method in accord with aspects of the present concepts, including the acts of inputting a batch of bulk coins into a self-service coin exchange machine 10 (act A300), processing the batch of bulk coins using the self-service coin exchange machine 10 to determine a total value of the processed coins (act A310), determining from the total value of the processed coins an exchange amount to be output in association with the coin exchange transaction (act A320), dispensing currency bills from the currency dispensing machine 110 having a value of a first portion of the exchange amount (act A330), and dispensing coins from the currency dispensing machine 110 (i.e., from a coin dispenser 111) having a value of a second portion of the exchange amount (act A340).

Figure 6:
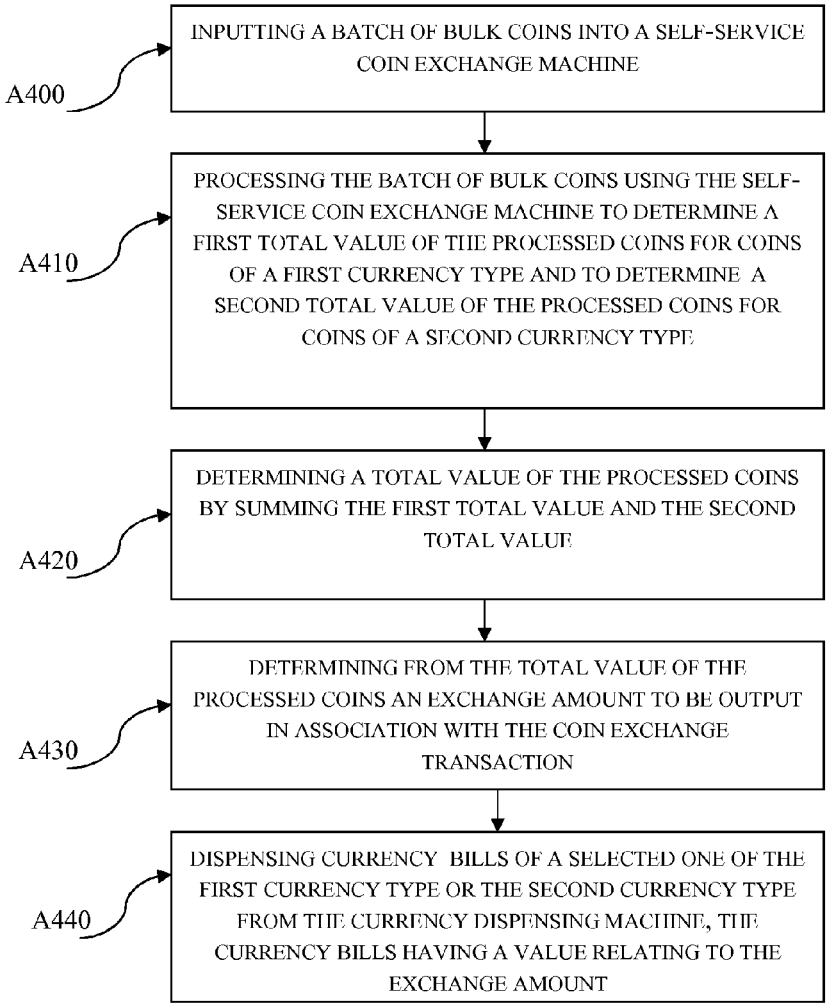
FIG. 6 shows aspects of one method in accord with at least some aspects of the present concepts.

FIG. 6 shows still another method in accord with aspects of the present concepts, including the acts of inputting a batch of bulk coins into a self-service coin exchange machine 10 (act A400), processing the batch of bulk coins using the self-service coin exchange machine 10 to determine a first total value of the processed coins for coins of a first currency type and to determine a second total value of the processed coins for coins of a second currency type (act A410), determining a total value of the processed coins by summing the first total value and the second total value (act A420), determining from the total value of the processed coins an exchange amount to be output in association with the coin exchange transaction (act A430), and dispensing currency bills of a selected one of the first currency type or the second currency type from the currency dispensing machine 110, the currency bills having a value relating to the exchange amount (act A440).

The foregoing disclosure has been presented for purposes of illustration and description. The foregoing description is not intended to limit the present concepts to the forms, features, configurations, modules, or applications described herein by way of example. Other non-enumerated configurations, combinations, and/or sub-combinations of such forms, features, configurations, modules, and/or applications are considered to lie within the scope of the disclosed concepts.

What is claimed is:

1. A method for exchanging coins in a retail environment, the method comprising:

substantially simultaneously receiving a plurality of coins of a first currency type in a coin input region of a bulk coin processing machine disposed in a retail environment, the coin processing machine comprising a currency dispensing device;

processing the plurality of coins to determine a total value of the plurality of coins; and returning the input total value of the plurality of coins to a patron of the bulk coin processing machine, minus any applied fees, in the form of currency bills or currency bills and coins of the first currency type dispensed from the currency dispensing device of the coin processing machine.

2. The method of claim 1, wherein no fees are applied and the value returned to the patron is equal to the total value.

3. The method for exchanging coins in a retail environment of claim 1, wherein the bulk coin processing machine is a stand-alone machine.

4. A stand-alone self-service coin exchange apparatus configured to exchange currency for coins in a public area, the stand-alone self-service coin exchange apparatus being disposed in a public area and comprising:

a coin input region configured to substantially simultaneously receive from a patron of a retail establishment a plurality of coins of arbitrary denomination;

a coin processing device configured to determine a total value of the input coins and to discharge the processed coins to one or more coin receptacles; and a currency dispenser comprising at least one bill dispenser configured to automatically dispense currency bills of at least one denomination and at least one coin dispenser configured to automatically dispense coins comprising at least one denomination, wherein the currency dispenser of the stand-alone self-service coin exchange apparatus is configured to automatically dispense currency bills and coins in an amount related to the total value of the input coins.

5. The stand-alone self-service coin exchange apparatus configured to exchange currency for coins in a public area according to claim 4, wherein the currency dispenser is configured to automatically dispense currency bills and coins in an amount equal to the total value, minus any imposed transaction fee or fees.

6. The stand-alone self-service coin exchange apparatus configured to exchange currency for coins in a public area according to claim 4, wherein the currency dispenser is configured to automatically dispense currency bills and coins in an amount equal to the total value.

* * * * *